US007533983B2

(12) United States Patent
Hirakawa

(10) Patent No.: US 7,533,983 B2
(45) Date of Patent: May 19, 2009

(54) IMAGE FORMING APPARATUS

(75) Inventor: Takashi Hirakawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 295 days.

(21) Appl. No.: 11/344,195

(22) Filed: Feb. 1, 2006

(65) Prior Publication Data

US 2006/0170726 A1 Aug. 3, 2006

(30) Foreign Application Priority Data

Feb. 2, 2005 (JP) ..... 2005-026688

(51) Int. Cl.
*B41J 2/01* (2006.01)
*B41J 2/15* (2006.01)

(52) U.S. Cl. ..... 347/102; 347/21

(58) Field of Classification Search ..... 347/102, 347/21, 31, 84, 96, 98, 100, 103, 5, 14, 16
See application file for complete search history.

(56) References Cited

U.S. PATENT DOCUMENTS 5,371,531 A * 12/1994 Rezanka et al. ..... 347/43
5,786,835 A * 7/1998 Ikeda et al. ..... 347/106
6,084,620 A * 7/2000 Morikawa et al. ..... 347/96
6,283,590 B1 * 9/2001 Peter ..... 347/102
6,412,934 B1 * 7/2002 Moriyama et al. ..... 347/96
6,716,562 B2 * 4/2004 Uehara et al. ..... 430/125.3

FOREIGN PATENT DOCUMENTS

JP 10-86353 A 4/1998
JP 2001-179959 A 7/2001

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The image forming apparatus comprises: an ink ejection device which ejects a droplet of ink toward a recording medium, the ink including a solvent and a coloring material dissolved or dispersed in the solvent; a treatment liquid deposition device which deposits a treatment liquid on the recording medium, the treatment liquid separating the coloring material from the solvent on the recording medium; a solvent absorbing device which absorbs the solvent on the recording medium; a solvent evaporating device which causes the solvent on the recording medium to evaporate; and a solvent removal selection device which selects one removal way of a first removal way where the solvent on the recording medium is removed by absorbing the solvent using the solvent absorbing device and then causing the solvent to evaporate using the solvent evaporating device, and a second removal way where the solvent on the recording medium is removed by causing the solvent to evaporate using the solvent evaporating device without using the solvent absorbing device.

7 Claims, 16 Drawing Sheets

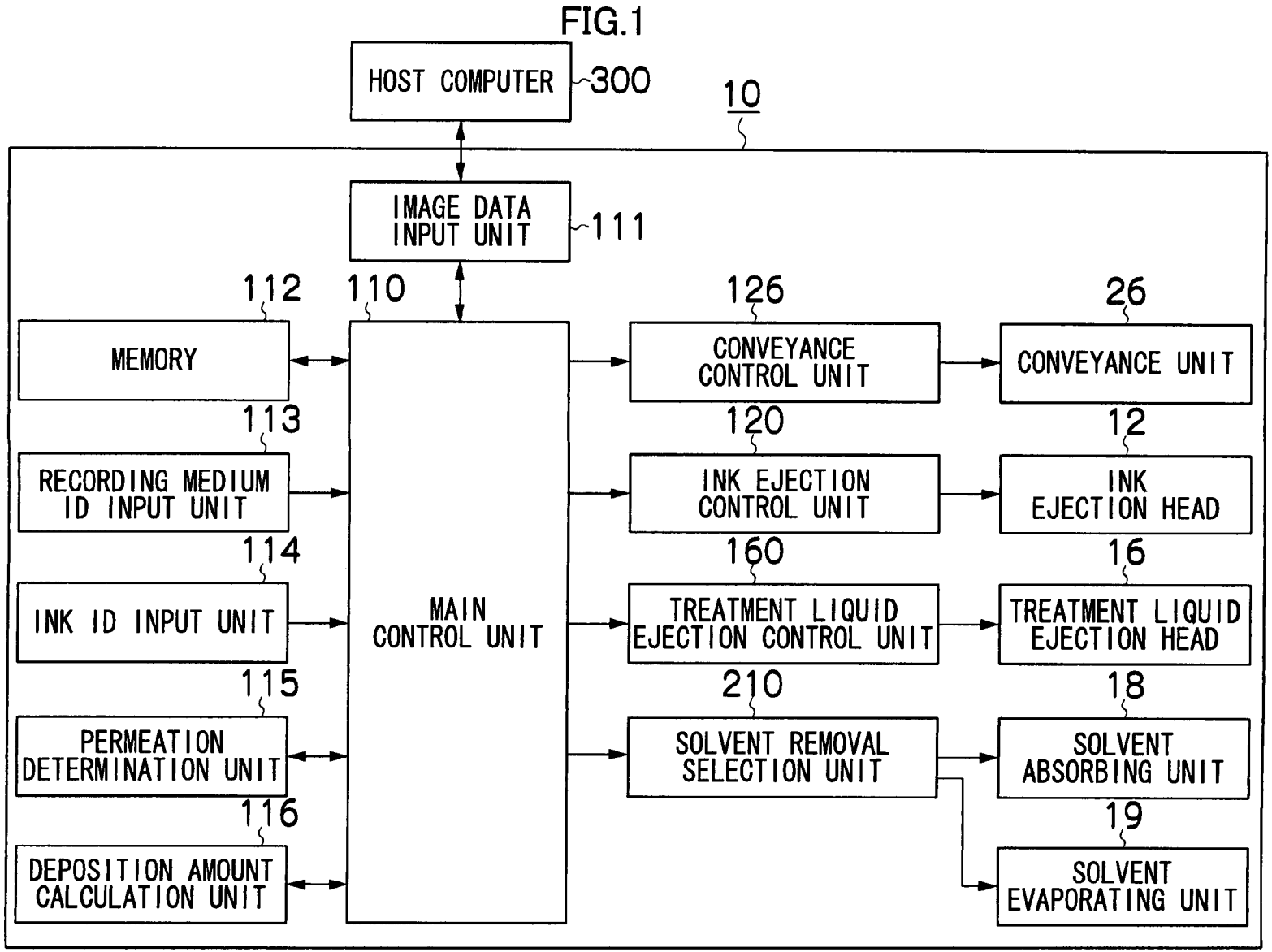
FIG.1
10
HOST COMPUTER
300
IMAGE DATA INPUT UNIT
111
MAIN CONTROL UNIT
110
CONVEYANCE CONTROL UNIT
126
INK EJECTION CONTROL UNIT
120
TREATMENT LIQUID EJECTION CONTROL UNIT
160
SOLVENT REMOVAL SELECTION UNIT
210
CONVEYANCE UNIT
26
INK EJECTION HEAD
12
TREATMENT LIQUID EJECTION HEAD
16
SOLVENT ABSORBING UNIT
18
SOLVENT EVAPORATING UNIT
19
MEMORY
112
RECORDING MEDIUM ID INPUT UNIT
113
INK ID INPUT UNIT
114
PERMEATION DETERMINATION UNIT
115
DEPOSITION AMOUNT CALCULATION UNIT
116

FIG.11

1130 1151

| RECORDING MEDIUM ID | NON-PERMEABLE/PERMEABLE |
|---|---|
| P001 | NON-PERMEABLE |
| C001 | PERMEABLE |
| ⋮ | ⋮ |

1121

FIG.12

1130 1140 1152

| RECORDING MEDIUM ID | INK ID | PERMEATION DURATION |
|---|---|---|
| P001 | i001 | |
| P001 | i002 | |
| C001 | i003 | |
| ⋮ | ⋮ | ⋮ |

1122

IMAGE FORMING APPARATUS

BACKGROUND OF THE INVENTION

1. Field of the Invention

The present invention relates to an image forming apparatus, and more particularly, to an image forming apparatus which forms images on a recording medium by ejecting droplets of ink onto the recording medium.

2. Description of the Related Art

The inkjet type image forming apparatus forms images on a recording medium by ejecting droplets of ink from nozzles toward the recording medium, such as a sheet of paper, while relatively moving the recording medium and an ink droplet ejection head having an arrangement of a plurality of nozzles (apertures).

In recent years, improvements in image quality have been sought in image forming apparatuses by increasing the density of the nozzles of the apparatuses. Generally, the ink used in the image forming apparatus of this kind contains a large volume of liquid solvent, such as water, organic solvent, or the like.

If the recording medium is a permeable medium in which the ink permeates the interior of the medium, then unless the solvent component in the ink deposited on the recording medium is not sufficiently removed, so-called "bleeding" can arise as the ink permeates the recording medium. The bleeding includes problems such as that the dot size becomes larger than the prescribed diameter, the boundary regions of the dots become blurred, the spreading of the dots becomes uneven, or the outline of each dot does not become smooth.

If the recording medium is a non-permeable medium in which the ink becomes fixed principally on the surface of the medium, then unless the solvent component in the ink deposited on the recording medium is not sufficiently removed, it is not possible to stably fix the coloring material component in the ink on the surface of the recording medium.

Therefore, various types of image forming apparatuses have been proposed which seek to remove liquid solvent from the ink deposited onto the recording medium.

Japanese Patent Application Publication No. 10-86353 (see FIG. 9 in particular) discloses an image forming apparatus in which a heating device or halogen heater for heating the recording medium is disposed below a platen which opposes an ink droplet ejection head, in such a manner that the recording medium can be heated by means of the single halogen heater, before the image recording, during the image recording, and after the image recording.

Japanese Patent Application Publication No. 2001-179959 (see, in particular, FIG. 1 and paragraphs 0012 and 0013) discloses an image forming apparatus having a roller disposed after an ink droplet ejection head in the conveyance direction of the recording medium. The roller is constituted by a solvent absorbing medium that absorbs liquid solvent in the ink deposited on the recording medium, and a separating member having separating properties that any of the coloring material in the ink hardly adheres to the separating member.

However, if the solvent component on the recording medium is to be removed by heating the recording medium, then even supposing that the recording medium is heated before, during, and after the image recording, a long amount of time is still required from the deposition of the ink on the recording medium until complete drying of the recording medium, and the amount of power consumption required for heating of this kind is constantly high.

On the other hand, if it is sought to absorb the solvent component on the recording medium by means of a roller, then the roller inevitably makes contact with the coloring material and the like. Hence, a surplus external pressure is applied to the coloring material component that is to be fixed onto the recording medium, thereby causing disturbance of the image on the recording medium.

In the method described in Japanese Patent Application Publication No. 2001-179959, especially if the recording medium is a non-permeable medium, the coloring material is repelled by the separating member of the roller in a state where the coloring material is not yet fixed on the recording medium, and hence the image is disturbed. If the separation properties of the separating member in the roller are incomplete, or if a roller having an external surface made of a solvent absorbing member without a separating member of this kind is used, then the coloring material may adhere to the roller when it is sought to sufficiently remove the solvent component, and the image is ultimately disturbed.

SUMMARY OF THE INVENTION

The present invention has been contrived in view of the foregoing circumstances, an object thereof being to provide an image forming apparatus that is capable of preventing or reducing the deterioration of image quality, in such a manner that an excessive external force is not applied to coloring material component of ink deposited on a recording medium while removing the solvent component of the ink.

In order to attain the aforementioned object, the present invention is directed to an image forming apparatus, comprising: an ink ejection device which ejects a droplet of ink toward a recording medium, the ink including a solvent and a coloring material dissolved or dispersed in the solvent; a treatment liquid deposition device which deposits a treatment liquid on the recording medium, the treatment liquid separating the coloring material from the solvent on the recording medium; a solvent absorbing device which absorbs the solvent on the recording medium; a solvent evaporating device which causes the solvent on the recording medium to evaporate; and a solvent removal selection device which selects one removal way of a first removal way where the solvent on the recording medium is removed by absorbing the solvent using the solvent absorbing device and then causing the solvent to evaporate using the solvent evaporating device, and a second removal way where the solvent on the recording medium is removed by causing the solvent to evaporate using the solvent evaporating device without using the solvent absorbing device.

Here, the types of ink include a dye-based ink in which a coloring material is dissolved in liquid solvent in a molecular state (or an ion state), a pigment-based ink in which a coloring material is dispersed in liquid solvent in a state of very fine lumps, and the like.

Furthermore, the treatment liquid can be, specifically, a liquid that acts so that the coloring material contained in the ink gets out of the state of dissolution or dispersion in the liquid solvent and changes to a state of separation from the solvent. Examples of the treatment liquid include: a treatment liquid which separates the coloring material in the ink from the solvent by causing the coloring material to separate or aggregate by reaction between the treatment liquid and the coloring material; a treatment liquid having an effect of promoting the separation between the coloring material and the solvent, without reacting directly with the coloring material; a treatment liquid which separates the coloring material in the ink from the solvent by generating a semi-solid substance (e.g., gel) containing the coloring material; and the like.

Preferably, the treatment liquid deposition device deposits the treatment liquid on the recording medium by ejecting a droplet of the treatment liquid toward the recording medium.

Alternatively, it is also preferable that the treatment liquid deposition device deposits the treatment liquid on the recording medium by applying the treatment liquid to the recording medium.

By adopting these compositions, it is possible to swiftly perform initial solvent removal by means of the solvent absorbing device and then to perform final solvent removal without contacting the recording medium by means of the solvent evaporating device. It is also possible to perform the solvent removal by means of evaporation by the solvent evaporating device only, without performing the absorption by the solvent absorption device. Therefore, excessive external force is not applied to the coloring material component of the ink deposited on the recording medium, and it is possible to reduce or prevent deterioration of the image quality.

Preferably, the image forming apparatus further comprises: a calculation device which calculates at least one of volume of the ink to be deposited on the recording medium and volume of the treatment liquid to be deposited on the recording medium, according to data of an image to be formed on the recording medium, wherein the solvent removal selection device selects the one removal way according to the at least one of the volume of the ink and the volume of the treatment liquid calculated by the calculation device.

By means of this composition, in image forming conditions where a variety of image data are inputted, then if the liquid volume is high in accordance with the data of the image that is actually to be formed, it is possible to swiftly perform the initial solvent removal by means of the solvent absorbing device, and to then perform the final solvent removal without contacting the recording medium by means of the solvent evaporating device. In contrast, if the liquid volume is small, then it is possible to change the solvent removal method so that only the solvent removal by means of evaporation by the solvent evaporating device is performed and the absorption by the solvent absorption device is not performed. Consequently, it is possible to prevent excessive external pressure from being applied to the coloring material component of the ink that is deposited on the recording medium in accordance with the various image data, and hence deterioration of the image quality can be reduced or prevented.

Preferably, the solvent removal selection device selects the one removal way according to permeation speed of the ink into the recording medium.

By means of this composition, depending on the permeation speed of the ink, it is possible to switch between performing initial solvent removal swiftly to a level where the coloring material component is unaffected by means of the solvent absorbing device followed by the final solvent removal without contacting the recording medium by means of the solvent evaporating device, and performing the solvent removal by means of only the evaporation by the solvent evaporating device without performing the absorption by the solvent absorption device. Consequently, it is possible to prevent excessive external pressure from being applied to the coloring material component of the ink deposited on the recording medium in accordance with the various image data, and hence deterioration of the image quality can be reduced or prevented.

Preferably, the image forming apparatus further comprises: a medium information input device to which identification information on the recording medium is inputted; and a storage device which stores relation information for each type of recording medium, the relation information indicating relation between the identification information on the recording medium and information indicating degree of permeation of the ink into the recording medium, wherein the solvent removal selection device selects the one removal way according to the identification information inputted to the medium information input device and the relation information stored in the storage device.

By means of this composition, in image forming conditions where a plurality of types of recording media are handled, depending on the recording medium on which the image is actually to be formed, it is possible to switch between performing the initial solvent removal swiftly to a level where the coloring material component is unaffected by means of the solvent absorbing device followed by the final solvent removal without contacting the recording medium by means of the solvent evaporating device, and performing the solvent removal by means of only the evaporation by the solvent evaporating device without performing absorption by the solvent absorption device. Consequently, it is possible to prevent excessive external pressure from being applied to the coloring material component of the ink deposited on the recording medium in accordance with various types of recording media, and hence deterioration of the image quality can be reduced or prevented.

Preferably, the solvent absorbing device is a roller which has an outer circumferential surface made of a material absorbing liquid and is rotatably disposed on a conveyance path along which the recording medium is conveyed; and the solvent removal selection device controls contact and separation between the outer circumferential surface of the roller and the recording medium conveyed along the conveyance path.

By means of this composition, it is possible to perform the initial solvent removal swiftly by the rotation of the roller, in cases where the solvent absorption is required. Furthermore, it is possible to achieve a composition in which the apparatus can be switched between performing and not performing the solvent absorption, by means of a simple mechanism that relatively moves the recording medium conveyed along the conveyance path and the outer circumferential surface of the roller towards each other, or away from each other.

According to the present invention, it is possible to perform final solvent removal by solvent evaporation without making contact with a recording medium, after swiftly performing initial solvent removal by solvent absorption, only in cases where it is necessary. Therefore, application of excessive external pressure to a coloring material component of ink deposited on the recording medium can be prevented, and deterioration in image quality can be reliably reduced or prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 1 is a block diagram showing the general composition of an image forming apparatus according to an embodiment of the present invention;

FIG. 11 is an illustrative diagram showing a first example of a recording medium information table used to determine the requirement for solvent absorption;

FIG. 12 is an illustrative diagram showing a second example of the recording medium information table used to determine the requirement for solvent absorption;

DETAILED DESCRIPTION OF THE PREFERRED EMBODIMENTS

General Composition of Image Forming Apparatus

Figure 2:
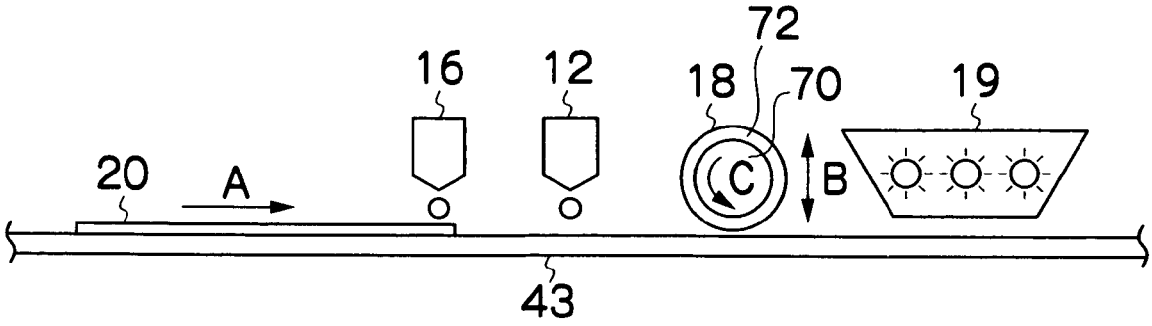
FIG. 2 is a schematic drawing showing the functional composition of the principal parts relating to image formation by the image forming apparatus.

FIG. 1 is a block diagram showing the general composition of the image forming apparatus according to an embodiment of the present invention.

In FIG. 1, the image forming apparatus 10 comprises: an ink droplet ejection head 12; a treatment liquid droplet ejection head (treatment liquid deposition device) 16; a solvent absorbing unit 18; a solvent evaporating unit 19; a conveyance unit 26; a main control unit 110; an image data input unit 111; a memory 112; a recording medium ID input unit 113; an ink ID input unit 114; a permeation determination unit 115; a deposition amount calculation unit 116; a conveyance control unit 126; an ink droplet ejection control unit 120; a treatment liquid droplet ejection control unit 160; and a solvent removal selection unit 210.

The ink droplet ejection head 12 ejects droplets of ink toward the recording medium, such as a sheet of paper.

As the ink, there are a dye-based ink in which a coloring material is dissolved in liquid solvent in a molecular state (or an ion state), a pigment-based ink in which a coloring material is dispersed in liquid solvent in a state of very fine lumps, and the like. In other words, the coloring materials contained in the ink may be materials which are dissolved in liquid solvent in the molecular state (or in an ion state), or materials which are dispersed in liquid solvent in the state of very fine lumps.

The treatment liquid droplet ejection head 16 ejects droplets of treatment liquid toward the recording medium.

The treatment liquid acts so that the coloring material contained in the ink gets out of the state of dissolution or dispersion in the liquid solvent and changes to a state of separation from the solvent. Examples of the treatment liquid include: a treatment liquid which separates the coloring material in the ink from the solvent by causing the coloring material to separate or aggregate by reaction between the treatment liquid and the coloring material; a treatment liquid having an effect of promoting the separation between the coloring material and the solvent, without reacting directly with the coloring material; a treatment liquid which separates the coloring material in the ink from the solvent by generating a semi-solid substance (e.g., gel) containing the coloring material; and the like. Hereinafter, the term "insolubilize" designates the action by which the coloring material in the ink is made to leave the state of dissolution or dispersal in the liquid solvent, by means of the above-described direct or indirect action of the treatment liquid to the coloring material in the ink.

The conveyance unit 26 conveys the recording medium along a prescribed conveyance path. In the present embodiment, the conveyance unit 26 includes a conveyance belt on which the recording medium is mounted by attraction, and a motor (conveyance belt drive motor) which drives the conveyance belt.

The main control unit 110 manages the units of the image forming apparatus 10 in accordance with a prescribed program.

The image data input unit 111 is inputted with image data from a host computer 300. In the present embodiment, more specifically, the image data is received from the host computer 300 by means of a wired communication interface, such as a universal serial bus (USB), IEEE 1394, or an Ethernet, or by means of a wireless communication interface. In the present embodiment, the image data input mode is not limited to the case where the image data is inputted by means of communications with the host computer 300. For example, it is also possible to input the image data by reading in the image data from a removable media, such as a memory card or optical disk.

The memory 112 stores a program for image formation processing, various information required in order to execute this program, image data inputted from the host computer 300, and the like.

In the present embodiment, the memory 112 stores reference information for determining the degree of permeation of the ink into the recording medium (determination reference information). There are various types of the determination reference information, and those various types of determination reference information are described later.

The recording medium ID input unit 113 is inputted with a recording medium ID (recording medium identification information), which identifies the type of the recording medium. In the present embodiment, more specifically, the recording medium ID is read in from a recording medium accommodating unit (not shown) accommodating a recording medium. The recording medium accommodating unit can be attached to and detached from the image forming apparatus 10. For example, there are an input mode in which the recording medium ID recorded in a barcode is read in, an input mode in which the recording medium ID is read in by radio communications from an IC tag (also called an "RFID": radio frequency identification), and the like. It is also possible to read in the recording medium ID from the recording medium itself. Moreover, it is possible to input information by communications with the host computer 300. Furthermore, it is also possible to input information by the user operation.

The ink ID input unit 114 is inputted with an ink ID (ink identification information), which identifies the type of the ink. In the present embodiment, more specifically, the ink ID is read in from an ink cartridge (not shown) accommodating the ink. The ink cartridge can be attached to and detached from the image forming apparatus 10. For example, there is an input mode in which the ink ID recorded in a barcode is read in, an input mode in which the ink ID is read in by radio communications from an IC tag, and the like. Moreover, it is possible to input information by communications with the host computer 300. Furthermore, it is also possible to input information by the user operation.

The permeation determination unit 115 determines the degree of permeation of the ink into the recording medium. There are various types of determination modes described later.

The deposition amount calculation unit 116 calculates the amount of ink to be deposited on the recording medium by the ink droplet ejection head 12, and the amount of treatment liquid to be deposited on the recording medium by the treatment liquid droplet ejection head 16, according to the image data inputted to the image data input unit 111. If the image data inputted to the image data input unit 111 is edited in the image forming apparatus 10, then the deposition amount is calculated according to the edited image data (i.e., the image data relating to the image formation).

The conveyance control unit 126 controls the conveyance unit 26. More specifically, the conveyance control unit 126 controls the attraction of the recording medium by the conveyance belt forming the conveyance unit 26, the driving the conveyance belt, and the like. Moreover, the conveyance control unit 126 changes contact duration per unit area between the recording medium and the solvent absorbing unit 18, by changing the conveyance speed of the recording medium.

The ink droplet ejection control unit 120 controls the droplet ejection of the ink to the recording medium by the ink droplet ejection head 12, according to the image data relating to image formation.

The treatment liquid droplet ejection control unit 160 controls the droplet ejection of the treatment liquid to the recording medium by the treatment liquid droplet ejection head 16, according to the image data relating to image formation.

The solvent absorbing unit 18 directly absorbs the liquid on the recording medium on which the treatment liquid and ink have been deposited. The liquid removed from the recording medium by the absorption is chiefly the solvent that has been separated from the coloring material in the ink on the recording medium by the action of the treatment liquid. If the treatment liquid is remaining on the recording medium, then the treatment liquid on the recording medium is also absorbed.

The solvent evaporating unit 19 causes the liquid on the recording medium to evaporate, without making contact with the recording medium. The liquid removed from the recording medium by the evaporation is chiefly the solvent that has been separated from the coloring material in the ink on the recording medium by the action of the treatment liquid. If the treatment liquid is remaining on the recording medium, then the treatment liquid on the recording medium is also caused to evaporate.

The solvent removal selection unit 210 selects whether to remove the solvent on the recording medium by causing the solvent to be absorbed by the solvent absorbing unit 18 and to then evaporate by the solvent evaporating unit 19, or by causing the solvent to evaporate using the solvent evaporating unit 19 without using the solvent absorbing unit 18.

For example, if the amount of the solvent evaporated by the solvent evaporating unit 19 is half of the maximum droplet deposition amount Dmax, that is to say Dmax/2, and the droplet deposition amount is equal to this maximum droplet deposition amount Dmax, then the removal of one half (Dmax/2) of the solvent is swiftly achieved by means of the absorption of the solvent by the solvent absorbing unit 18, and the removal of the remaining half (Dmax/2) of the solvent is achieved by evaporation of the solvent by the solvent evaporating unit 19 without making contact with the recording medium.

Moreover, the solvent removal selection unit 210 is capable of changing the interval (clearance) between the recording medium and the solvent absorbing unit 18. Furthermore, the solvent removal selection unit 210 also has a function for controlling the contact pressure of the solvent absorbing unit 18 with respect to the recording medium.

In the present embodiment, a microprocessor functions as the whole or part of the main control unit 110, the permeation determination unit 115, the deposition amount calculation unit 116, the ink droplet ejection control unit 120, the conveyance control unit 126, and the treatment liquid droplet ejection control unit 160.

FIG. 2 is a schematic drawing showing an example of the mechanical structure of the principal parts of the image forming apparatus 10 according to the present embodiment.

In FIG. 2, the recording medium 20 is attracted by a conveyance belt 43, which forms a portion of the conveyance unit 26 in FIG. 1, and is conveyed in the direction of the arrow A in FIG. 2 (the conveyance direction). In the conveyance path along which the recording medium 20 is conveyed while being attracted to the conveyance belt 43, the treatment liquid droplet ejection head 16 is disposed on the upstream side with respect to the ink droplet ejection head 12 (i.e., before the ink droplet ejection head 12). On the other hand, the solvent absorbing unit 18 or a porous roller is disposed on the downstream side with respect to the ink droplet ejection head 12 (i.e., after the ink droplet ejection head 12). Moreover, the solvent evaporating unit 19 or a halogen heater is disposed on the downstream side with respect to the porous roller 18 (i.e., after the porous roller 18).

Although not shown in FIG. 2, the ink droplet ejection head 12 includes a plurality of heads of colors, such as black (K), cyan (C), magenta (M), yellow (Y), and the like.

The porous roller 18 is a rotatable body, having a structure in which a layer of a porous member 72 absorbing liquid is formed on the outer circumference of a metal member 70 forming the inner portion of the rotatable body.

The porous roller 18 is designed in such a manner that the outer circumferential surface thereof (the surface of the porous member 71) can be moved away from or moved toward the conveyance surface of the conveyance belt 43, by raising or lowering the porous roller 18 in the direction of the arrow B in FIG. 2 (separating/approaching direction).

The porous roller 18 absorbs liquid on the recording medium 20 while rotating in the direction of the arrow C in FIG. 2 (the direction of rotation) in a state that the porous roller 18 is disposed near the conveyance belt 43. In this case, the porous roller 18 makes contact with at least the solvent on the recording medium 20 and absorbs that solvent.

It is possible that the solvent on the recording medium 20 is absorbed through the porous roller 18 making no actual contact with the recording medium 20, while a slight gap is formed between the recording medium 20 and the bottommost part of the porous roller 18 by accurately controlling the movement of the porous roller 18 toward and away from the conveyance belt 43.

Below, in order to simplify the description, the term "making contact with" the recording medium 20 designates the state where the porous roller 18 makes contact with the solvent deposited on the recording medium 20 even if the porous roller 18 does not make actual contact with the recording medium 20 itself, in addition to the state where the porous roller 18 makes actual contact with the recording paper 20 itself.

In the present embodiment, the solvent absorbing device is not limited in particular to the porous roller, but an absorbing member made of a material capable of swiftly removing the liquid on the recording medium, without applying significant pressure to the coloring material on the recording medium, is used as the solvent absorbing device.

Furthermore, in the present embodiment, the mode of evaporating the solvent is not limited in particular to the mode in which the solvent is evaporated by heating with the halogen heater 19, and it is possible to use any device that evaporates the solvent without making contact with the recording medium. For example, it is possible to cause the liquid on the recording medium 20 to evaporate by applying an air flow to the image-forming-surface of the recording medium 20.

Structure of Droplet Ejection Head

Next, an example of the structure of the ink droplet ejection head 12 and the treatment liquid droplet ejection head 16 is described with reference to FIGS. 3 and 4.

Below, a case where the ink droplet ejection head 12 and the treatment liquid droplet ejection head 16 have a common structure is described, as an example. The ink droplet ejection head 12 and the treatment liquid droplet ejection head 16 are denoted here with reference numeral 50, which represents both of the droplet ejection heads 12 and 16.

Figure 3:
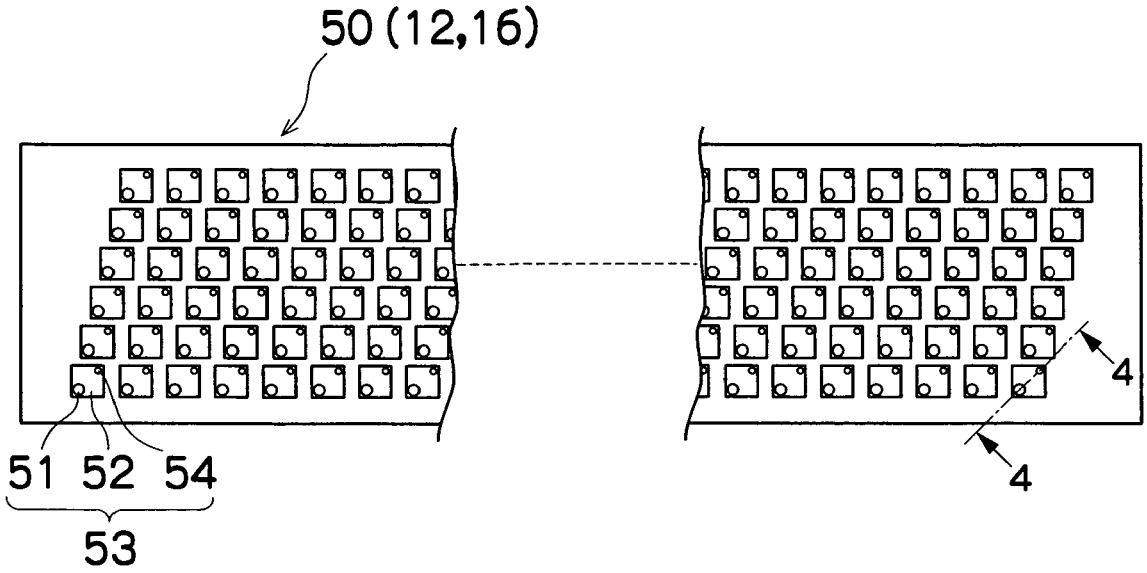
FIG. 3 is a plan view perspective diagram showing an example of the structure of a droplet ejection head.
Figure 4:
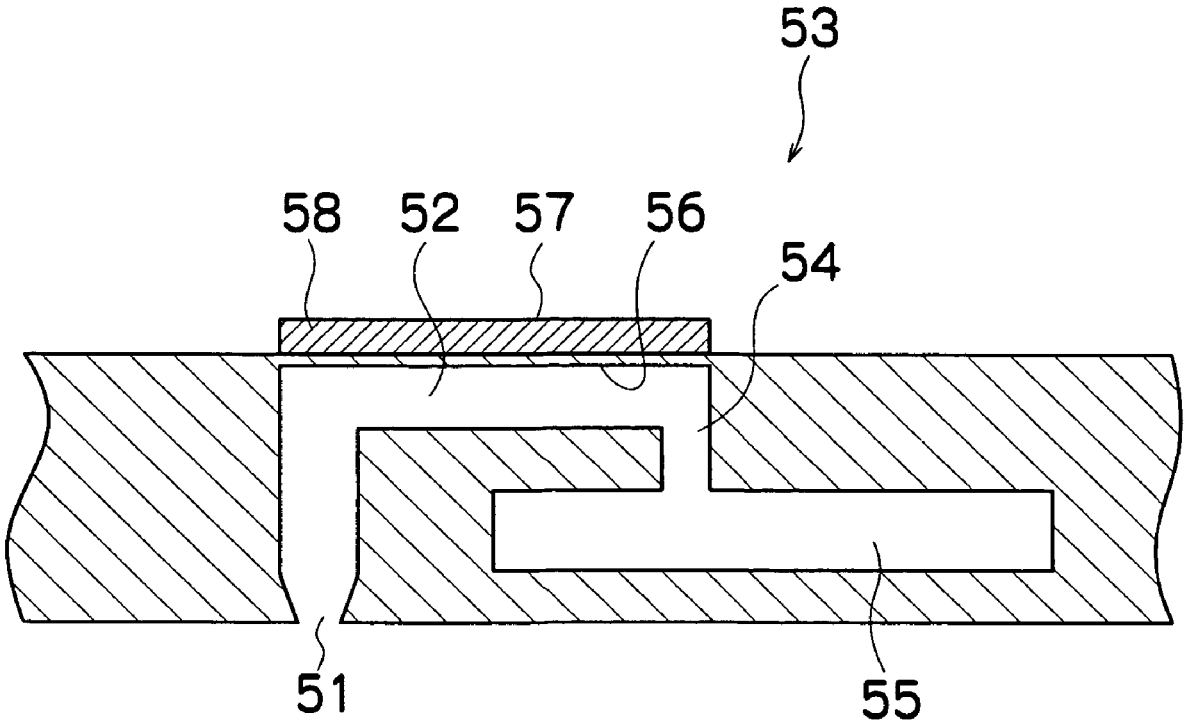
FIG. 4 is a cross-sectional diagram along line 4-4 in FIG. 3.

FIG. 3 is a plan view perspective diagram showing an example of the structure of the droplet ejection head 50, and FIG. 4 is a cross-sectional view along line 4-4 in FIG. 3.

In order to increase the density of the dots formed by ejecting the droplets of ink onto the recording medium 20, it is necessary to form the nozzles to a high density in the droplet ejection head 50.

As shown in FIG. 3, the droplet ejection head 50 according to the present embodiment has a structure in which a plurality of liquid droplet ejection elements 53 are disposed two-dimensionally in the form of a staggered matrix. The effective nozzle interval (the projected nozzle pitch) as projected in the lengthwise direction of the droplet ejection head 50 (the direction substantially perpendicular to the conveyance direction of the recording medium) is thereby reduced (high nozzle density is achieved). Each liquid droplet ejection elements 53 includes a nozzle 51 forming a liquid droplet ejection port, a pressure chamber 52 corresponding to the nozzle 51, a supply port 54, and the like.

As shown in FIG. 4, each pressure chamber 52 is connected to a common flow passage 55 via the supply port 54. The common flow passage 55 is connected to a tank (not shown) which forms a supply source of the ink (or treatment liquid), and the ink (or treatment liquid) supplied from this tank is distributed to the respective pressure chambers 52 via the common flow passage 55 in FIG. 4. An actuator 58 provided with an individual electrode 57 is joined to a pressure plate (common electrode) 56 which forms the upper face of the pressure chamber 52. The actuator 58, which includes a piezoelectric element for example, is deformed when a drive voltage is applied to the individual electrode 57 and the common electrode 56 to change the volume of the pressure chamber 52, and the ink (or treatment liquid) is caused to be ejected from the nozzle 51 by the pressure change in accordance therewith. After the ejection, new ink (or new treatment liquid) is supplied to the pressure chamber 52 from the common flow channel 55 via the supply port 54.

Although the case where structure of the treatment liquid droplet ejection head 16 is the same as the structure of the ink droplet ejection head 12 is described above, the present invention is not particularly limited to the case where the treatment liquid droplet ejection head 16 has the same structure as the ink droplet ejection head 12. The treatment liquid droplet ejection head 16 may have different structures from that of the ink droplet ejection head 12.

Structure of Solvent Absorbing Unit

Next, structural examples of the solvent absorbing unit having the porous roller 18, and the parts associated with the solvent absorbing unit, are described below with reference to FIGS. 5 and 6.

Figure 5:
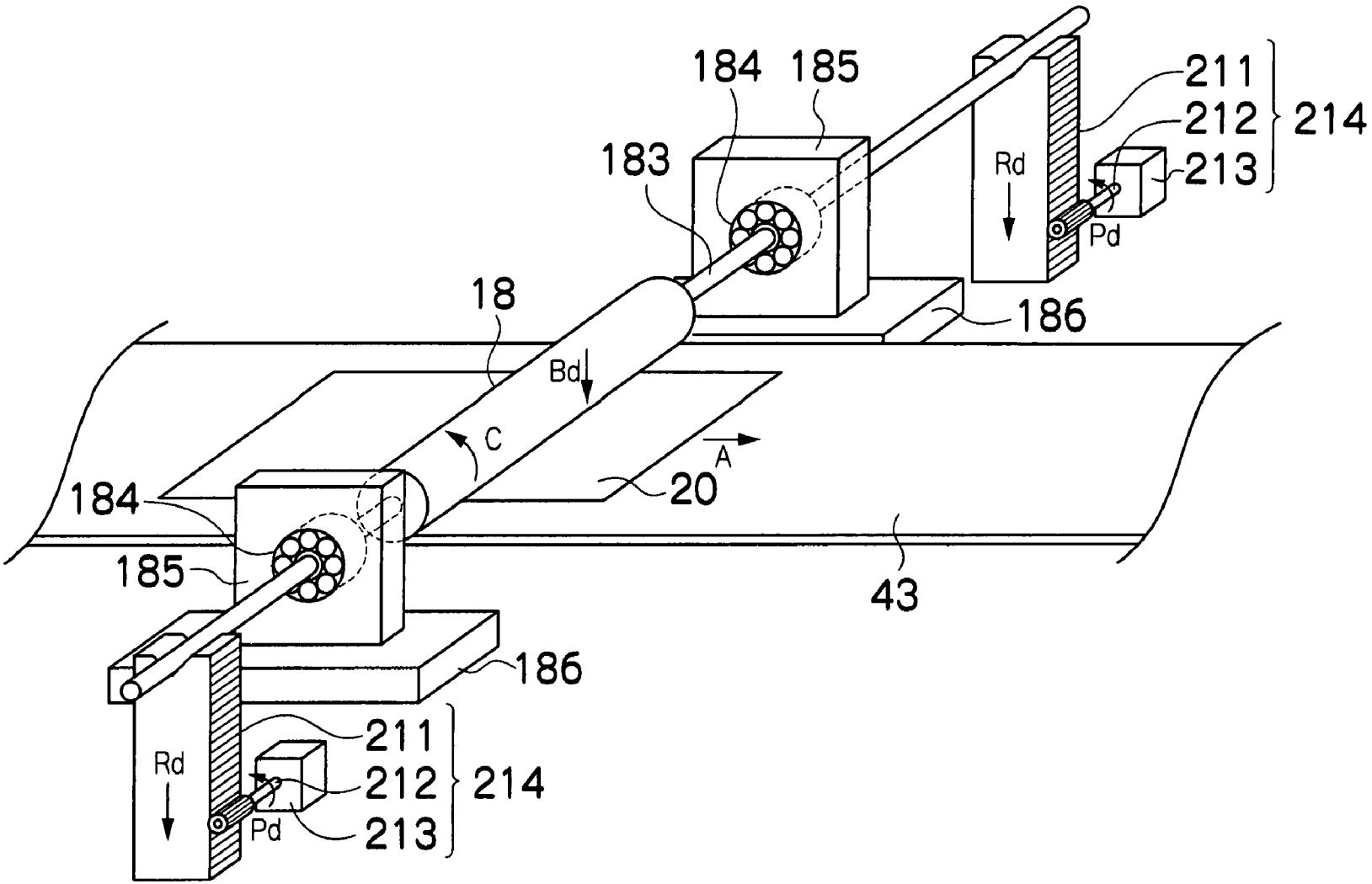
FIG. 5 is an oblique diagram showing a situation where a solvent absorbing unit is used.

FIG. 5 is an oblique diagram showing the porous roller 18 in a state where it has been selected that the absorption of the liquid solvent on the recording medium 20 is to be performed. FIG. 6 is an oblique diagram showing the porous roller 18 in a state where it has been selected that the absorption of the liquid solvent on the recording medium 20 is not to be performed.

The porous roller 18 is supported by elevating devices 214 through an axis 183, in such a manner that the axial direction thereof is perpendicular to the conveyance direction of the recording medium 20. Each of the elevating devices 214 includes a rack 211, a pinion 212, and a rotational motor 213. The elevating devices 214 convert the rotational actions of the pinions 212, which are driven by the motors 213, into the linear movements of the racks 211, thereby causing the outer circumferential surface of the porous roller 18, which is made of a porous member, to separate from or make contact with the recording medium 20 on the conveyance belt 43. The elevating devices 214 including the racks 211, the pinions 212 and the motors 213 compose a part of the solvent removal selection unit 210 shown in FIG. 1.

Moreover, roller supporting sections 185 to rotatably support the porous roller 18 have bearing sections 184, which rotatably support the rotating axis 183 of the porous roller 18. When the porous roller 18 is lowered by the elevating device 214 to the contact position, where the porous roller 18 makes contact with the recording medium 20, then the porous roller 18 is stably supported by the roller supporting sections 185 because the bottom faces of the roller supporting sections 185 make contact with the upper faces of seats 186.

More specifically, as shown in FIG. 5, when the pinions 212 are rotated in the direction of the arrows Pd in FIG. 5 by the drive of the motors 213, then these rotational movements are converted into linear movements, the racks 211 move linearly in the direction of the arrows Rd (downward direction) in FIG. 5, the porous roller 18 moves in the direction of the arrow Bd in FIG. 5 (downward direction) by means of the rotating axis 183, and the bottommost part of the outer circumferential surface of the porous roller 18 moves toward the recording medium 20. The porous roller 18 moves in the direction of the arrow Bd in FIG. 5, until the bottom faces of the roller supporting sections 185 abut against the upper faces of the seats 186, and the roller supporting sections 185 rotatably support the porous roller 18 through the bearing sections 184 and the rotating axis 183. The porous roller 18 rotates in the direction of the arrow C in FIG. 5 while absorbing the solvent on the recording medium 20, which is attracted on the conveyance belt 43 and conveyed in the direction of the arrow A in FIG. 5. The recording medium 20 where the solvent has been absorbed to a certain degree by the porous roller 18 is conveyed to a position for performing solvent evaporation, while the recording medium 20 is still attracted to the conveyance belt 43.

Figure 6:
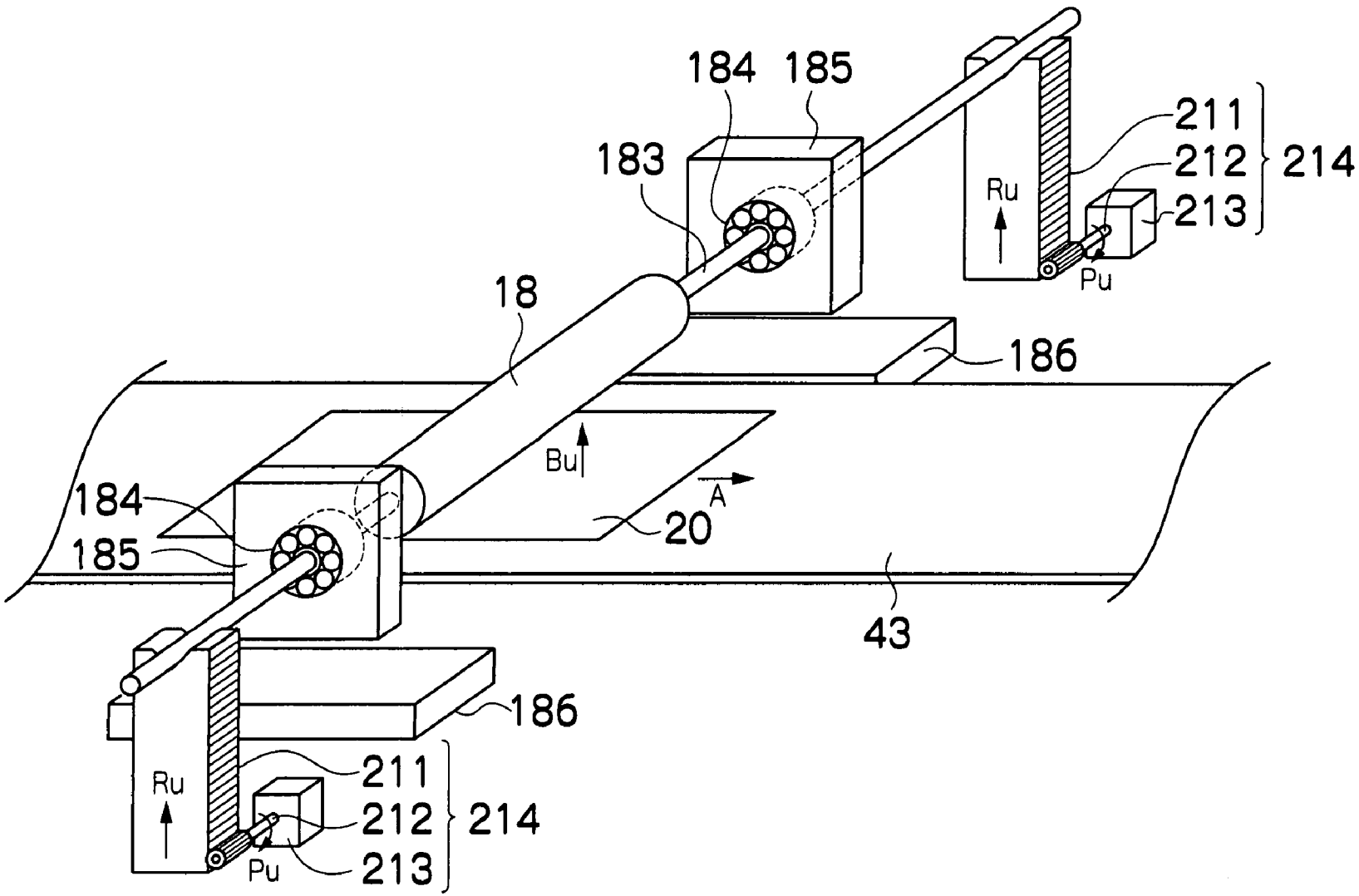
FIG. 6 is an oblique diagram showing a situation where the solvent absorbing unit is not used.

On the other hand, as shown in FIG. 6, when the pinions 212 are rotated in the direction of the arrows Pu in FIG. 6 by the drive of the motors 214, then these rotational movements are converted into linear movements, the racks 211 move linearly in the direction of the arrows Ru (upward direction) in FIG. 6, the porous roller 18 moves in the direction of the arrow Bu in FIG. 6 (upward direction) by means of the rotating axis 183, and the bottommost part of the outer circumferential surface of the porous roller 18 moves away from the recording medium 20. In other words, the porous roller 18 is set in a non-absorbing position where it does not absorb the solvent on the recording medium 20. Furthermore, when the porous roller 18 moves in the direction of the arrow Bu in FIG. 6, the contact between the bottom faces of the roller supporting sections 185 and the upper faces of the seats 186 is released. Since the external circumferential surface of the porous roller 18 is separated from the recording medium 20 conveyed on the conveyance belt 43 in the direction of the arrow A in FIG. 6, then the recording medium 20 is conveyed to a position for performing the solvent evaporation while the recording medium 20 is still attracted on the conveyance belt 43, without performing the solvent absorption by the porous roller 18.

The motors 213 are driven under the control of the main control unit 110 shown in FIG. 1. The porous roller 18 is in contact with or separated from the recording medium 20 attracted on the conveyance belt 43 in accordance with the driving of the motors 213. If the solvent absorption is to be performed by the porous roller 18, then as shown in FIG. 5, the porous roller 18 is set in the state in which the outer circumferential surface of the porous roller 18 is placed in contact with the recording medium 20. On the other hand, if the solvent absorption is not to be performed by the porous roller 18, then as shown in FIG. 6, the porous roller 18 is set in the state where the outer circumferential surface thereof is separated from the recording medium 20.

By controlling the driving of the motors 213, it is possible to change the clearance between the porous roller 18 and the recording medium 20, and it is also possible to cause the porous roller 18 to press against the recording medium 20, thereby changing the contact pressure therebetween.

Structure of Solvent Evaporating Unit

Next, a structural example of the solvent evaporating unit including the halogen heater 19 is described below with reference to FIG. 7.

Figure 7:
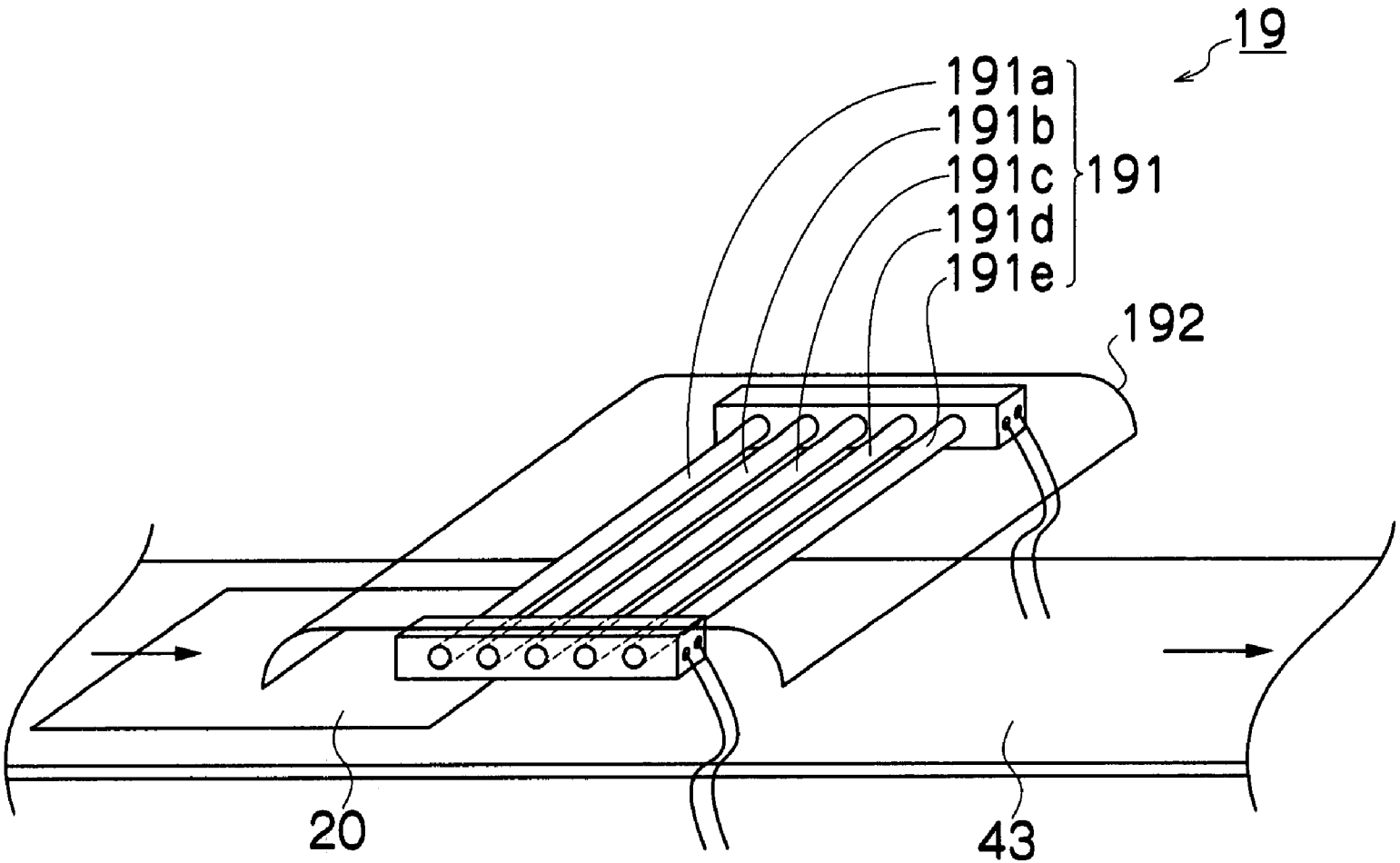
FIG. 7 is an oblique perspective diagram showing an example of a solvent evaporating unit.

FIG. 7 is an oblique perspective diagram showing the halogen heater 19 in a state where the liquid solvent on the recording medium 20 is being evaporated. In FIG. 7, the halogen heater 19 includes a plurality of halogen lamps 191 (191*a*, 191*b*, 191*c*, 191*d* and 191*e*), which generate heat, and a reflection plate 192, which reflects the heat generated by the halogen lamps 191 toward the recording medium 20. Each halogen lamp 191 is longer in the lengthwise direction than the width of the recording medium 20 (the length of the recording medium in the main scanning direction), and is disposed in such a manner that its lengthwise direction is substantially perpendicular to the conveyance direction of the recording medium 20 (sub-scanning direction). The recording medium 20 is conveyed by the conveyance belt 43 in a state where the recording medium 20 opposes the plurality of halogen lamps 191 and the reflection plate 192, while the recording medium 20 is heated uniformly and efficiently by the plurality of halogen lamps 191 with the reflection plate 192. In this way, the liquid on the recording medium 20 is evaporated evenly and sufficiently.

Concrete Example of Insolubilization

Concrete examples of insolubilization are described below with reference to FIGS. 8A through 10.

FIGS. 8A to 8F are schematic drawings showing one example of a mode where the treatment liquid and the ink are deposited on the recording medium 20, and the coloring material of the ink does not permeate the interior of the recording medium 20.

Figure 8A:
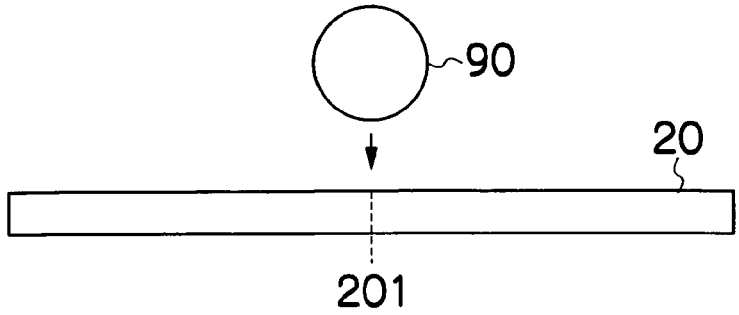
FIGS. 8A to 8F are schematic drawings showing an example of a mode in which treatment liquid and ink are deposited on the recording medium.
Figure 8B:
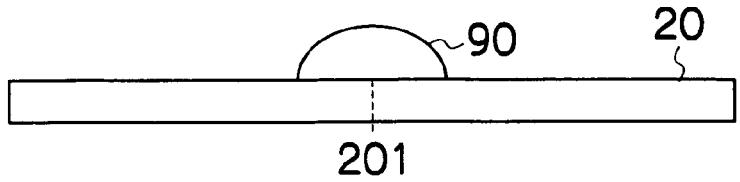

Firstly, as shown in FIG. 8A, when an observation point 201 on the recording medium 20 reaches a position in the conveyance path at which a droplet of the treatment liquid is to be deposited (treatment liquid droplet deposition position), then a droplet 90 of the treatment liquid is ejected and deposited onto the recording medium 20, and the treatment liquid droplet 90 is deposited on the observation point 201 of the recording medium 20 as shown in FIG. 8B.

Figure 8C:
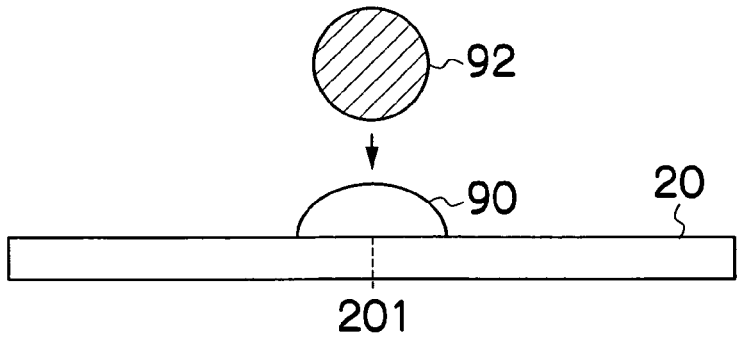
Figure 8D:
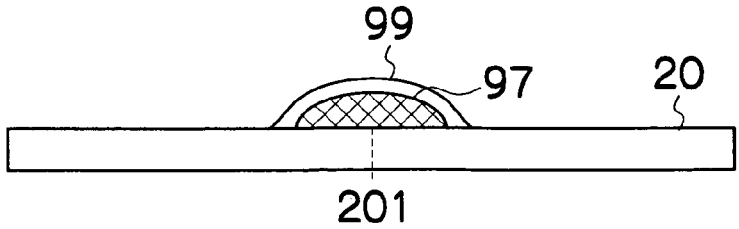

Next, as shown in FIG. 8C, when the observation point 201 on the recording medium 20 arrives at a position on the conveyance path where a droplet of the ink is to be deposited (ink droplet deposition position), then a droplet 92 of the ink is ejected toward the recording medium 20. Since the droplet 90 of the treatment liquid has already been deposited on the observation point 201 of the recording medium 20, the ink droplet 92 newly deposited onto the recording medium 20 and the treatment liquid droplet 90 react with each other. Then, as shown in FIG. 8D, the coloring material 97 and the solvent 99 in the ink separate almost completely into two parts.

Figure 8E:
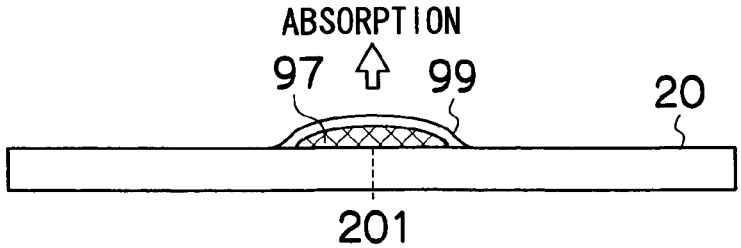

If the porous roller 18 is set in the absorbing position as shown in FIG. 5, then a portion of the solvent 99 on the recording medium 20 is absorbed by the outer circumferential surface of the porous roller 18 as shown in FIG. 8E.

Figure 8F:
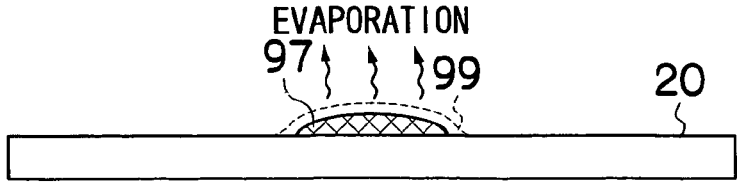

Furthermore, when the recording medium 20 is conveyed while facing the halogen heater 19 as shown in FIG. 7, then the solvent 99 on the recording medium 20 is heated and evaporated by the halogen heater 19 as shown in FIG. 8F. The coloring material 97 thereby becomes fixed onto the surface of the recording medium 20.

On the other hand, if the porous roller 18 is set in the non-absorbing position as shown in FIG. 6, then the solvent absorption is not performed by the porous roller 18, and only the solvent evaporation by the halogen heater 19 is performed.

FIGS. 9A to 9F are schematic drawings showing a further example of a mode where the treatment liquid and the ink are deposited on the recording medium 20, and the coloring material of the ink permeates the interior of the recording medium 20.

Figure 9A:
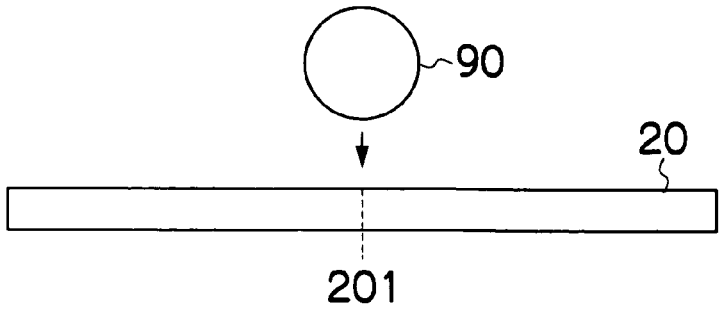
FIGS. 9A to 9F are schematic drawings showing a further example of a mode in which treatment liquid and ink are deposited on the recording medium.
Figure 9B:
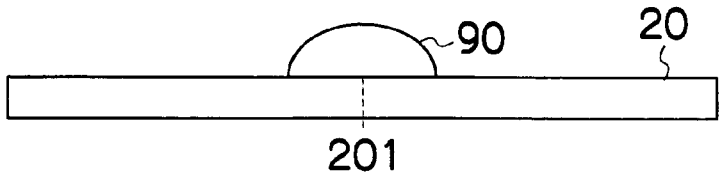
Figure 9C:
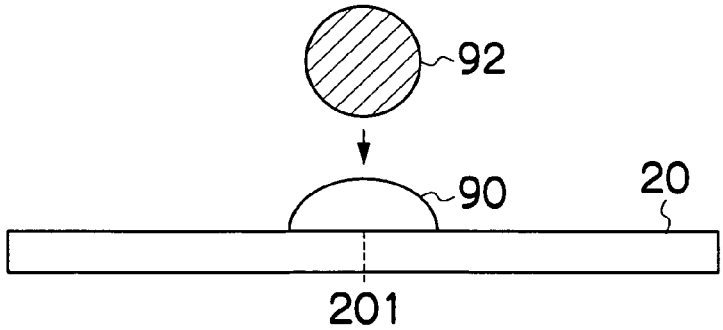
Figure 9D:
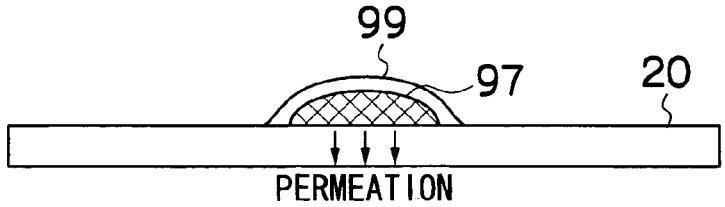

Firstly, as shown in FIG. 9A, a droplet 90 of the treatment liquid is ejected toward the observation point 201 of the recording medium 20, and as shown in FIG. 9B, the treatment liquid droplet 90 is deposited on the observation point 201 of the recording medium 20. Then, as shown in FIG. 9C, a droplet 92 of the ink is ejected toward the observation point 201 of the recording medium 20, and the treatment liquid droplet 90 and the ink droplet 92 react with each other on the recording medium 20, causing the coloring material 97 and the solvent 99 in the ink to separate into two parts as shown in FIG. 9D. Simultaneously with the start of the separation, the coloring material 97 starts to permeate the recording medium 20.

Figure 9E:
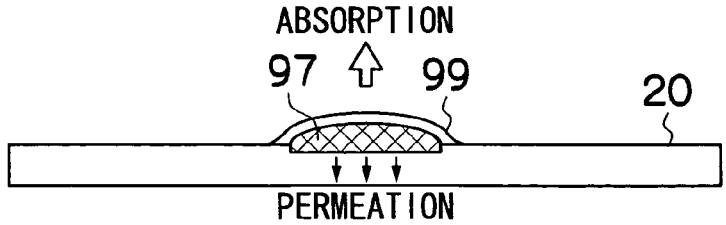
Figure 9F:
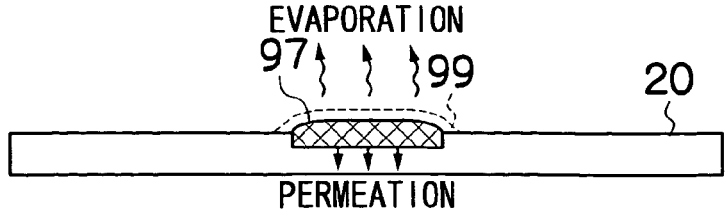

If the porous roller 18 is set in the absorbing position as shown in FIG. 5, then a portion of the solvent 99 on the recording medium 20 is absorbed by the outer circumferential surface of the porous roller 18 as shown in FIG. 9E. After that, the solvent 99 on the recording medium 20 is heated and evaporated by the halogen heater 19, as shown in FIG. 9F. The coloring material 97 thereby becomes fixed on the surface and in the interior of the recording medium 20.

On the other hand, if the porous roller 18 is set in the non-absorbing position as shown in FIG. 6, then the solvent absorption is not performed by the porous roller 18, and only the solvent evaporation by the halogen heater 19 is performed.

Next, a detailed example of a case where the coloring material in the ink is insolubilized by a two liquid (anionic/cationic) reaction between the ink and the treatment liquid is described below with reference to FIG. 10.

Figure 10:
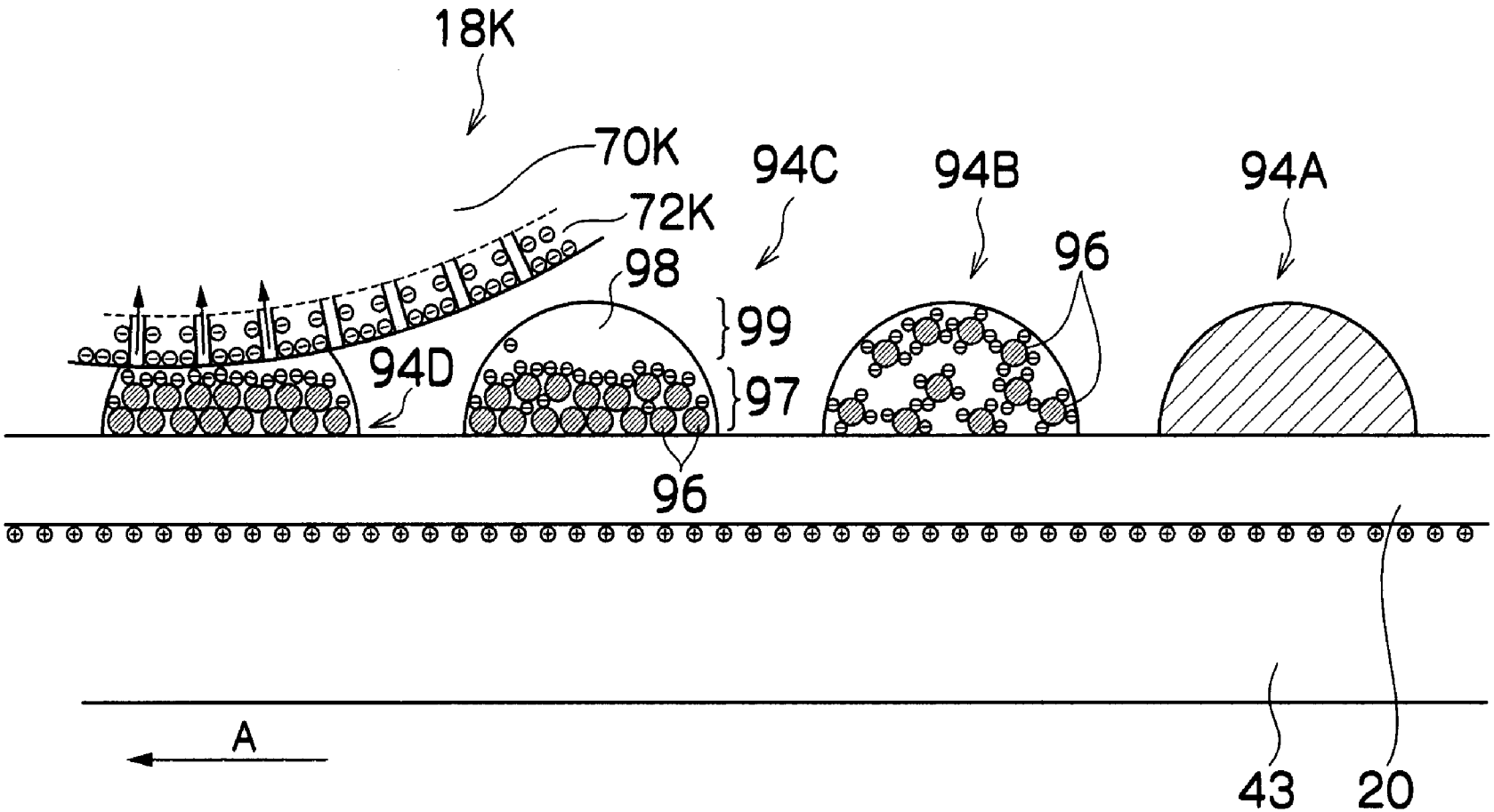
FIG. 10 is a schematic drawing showing the details of an example of a mode of insolubilization of the coloring material.

In the example shown in FIG. 10, a mixture droplet 94A composed of the treatment liquid droplet 90 and the ink droplet 92 deposited on the recording medium 20 changes to a mixture droplet 94B containing coloring material aggregate 96 which is charged negatively, due to the two-liquid reaction. Thereupon, the coloring material aggregate 96 in the mixture droplet 94B settles down, and the mixture droplet 94B changes to a mixture droplet 94C in which a coloring material layer 97 formed by the coloring material aggregate 96 is separated from a solvent layer 99 formed by the solvent 98.

Figure 14:
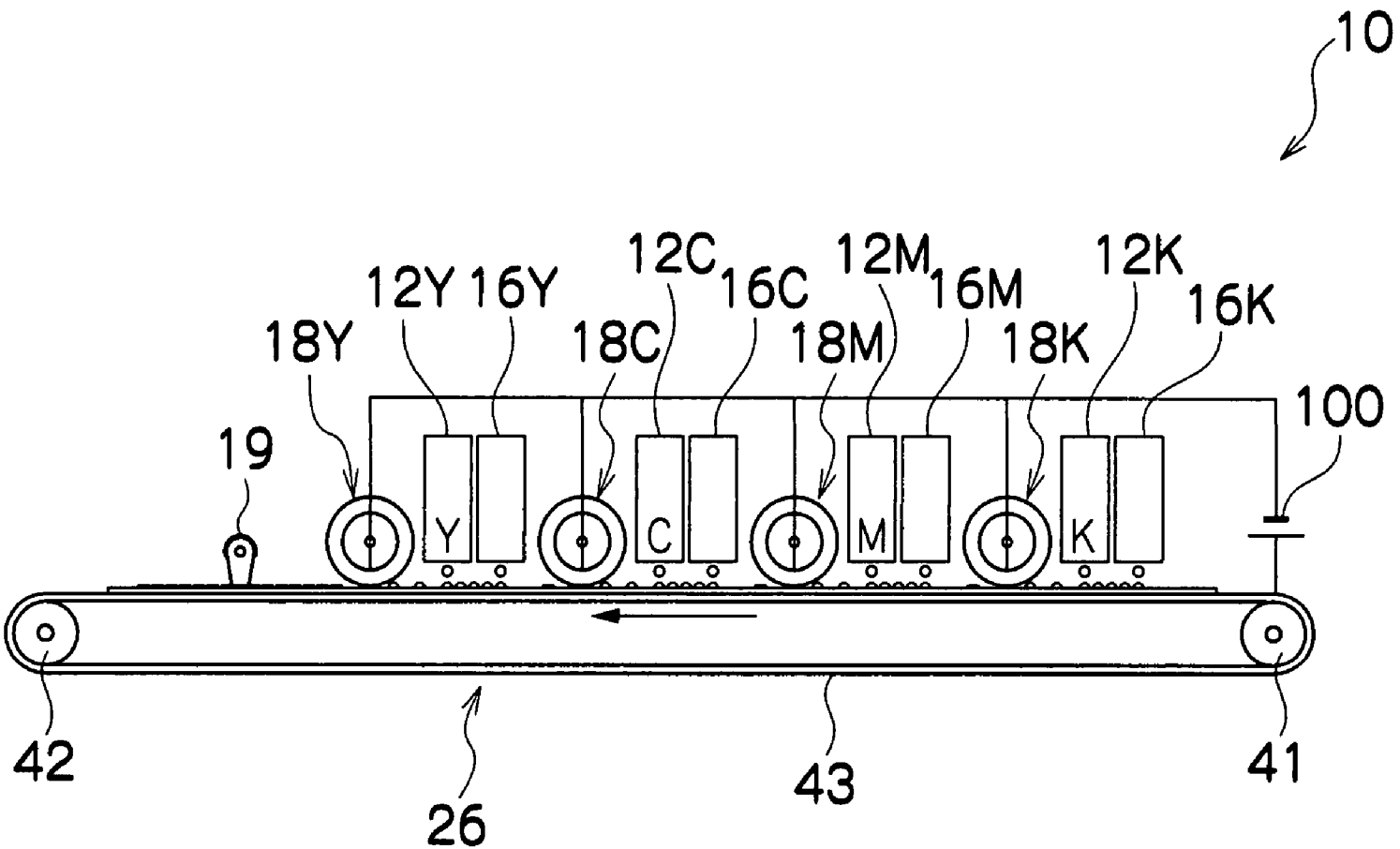
FIG. 14 is a schematic drawing showing the principal part of an example of an image forming apparatus composed in such a manner that droplets of treatment liquid are ejected respectively for inks of a plurality of colors.
Figure 15:
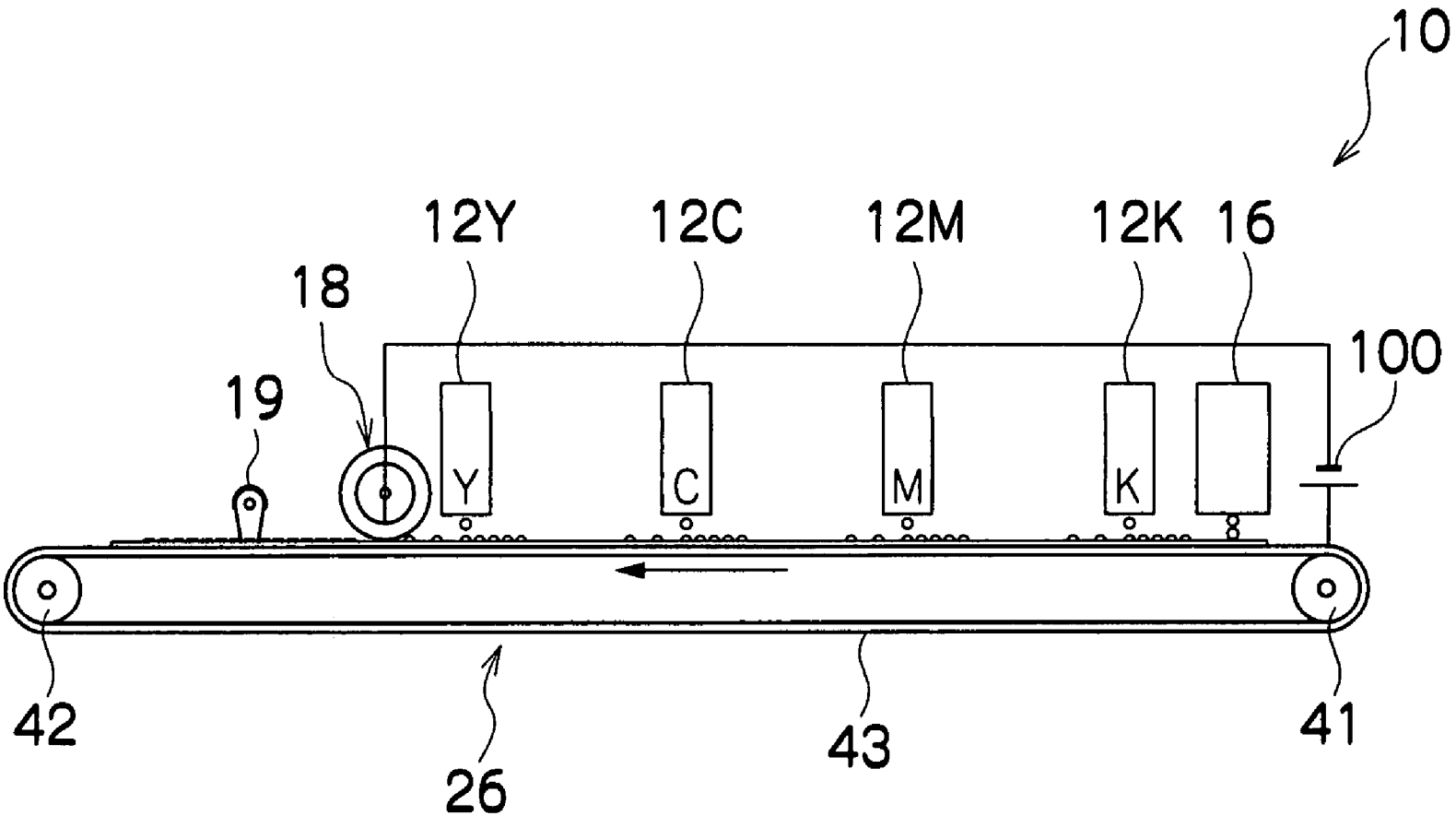
FIG. 15 is a schematic drawing showing the principal part of an example of an image forming apparatus composed in such a manner that droplets of treatment liquid are ejected in one operation before the ejection of droplets of inks of a plurality of colors.
Figure 16:
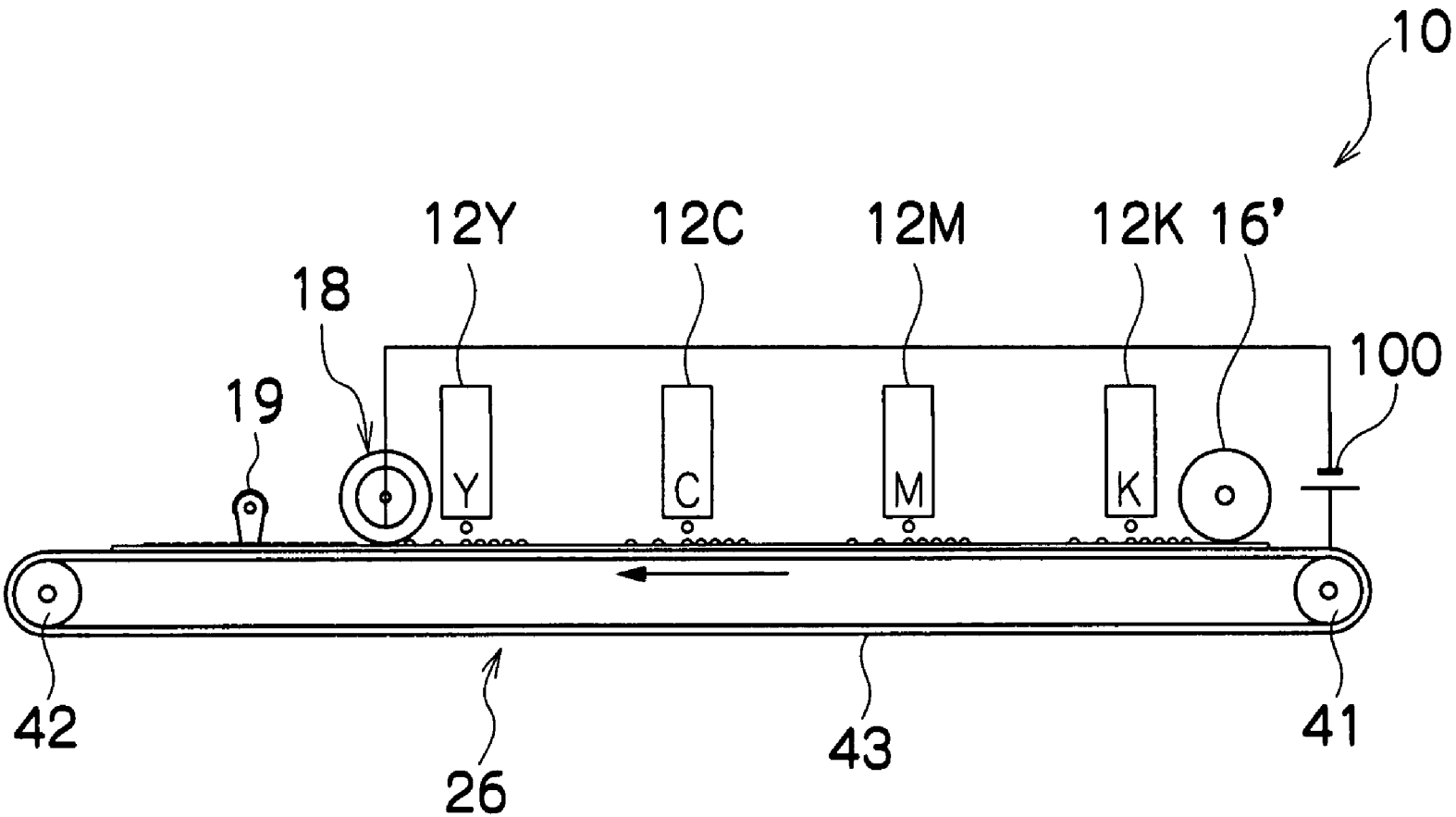
FIG. 16 is a schematic drawing showing the principal part of an example of an image forming apparatus composed in such a manner that the treatment liquid is applied through a roller.

On the other hand, the conveyance belt 43 is charged to the opposite polarity to the coloring material aggregate 96 (in other words, the conveyance belt 43 is positively charged) by a voltage applying device 100 through a drive roller 41 on which the conveyance belt 43 is wound (see FIGS. 14 to 16). By charging the conveyance belt 43 to the opposite polarity to the coloring material aggregate 96, an electrostatic attraction acts in such a manner that the coloring material aggregate 96 is drawn toward the conveyance belt 43, and therefore, the downward settling of the coloring material aggregate 96 can be accelerated and the coloring material 96 and the solvent 98 can be reliably separated.

It is also possible to control the electrical properties of a metal member 70K of the porous roller to control the solvent absorption by a porous member 72K. Thus, the mixture droplet 94C changes to a mixture droplet 94D from which the solvent is absorbed by porous member 72K as shown in FIG. 10.

Determination of Requirement for Solvent Absorption

Examples of the determination of whether the solvent absorption on the recording medium 20 is to be performed or not are described below.

A first mode of the determination of the requirement of the solvent absorption is described below, principally with reference to FIG. 11. A first determination reference information table 1121 shown in FIG. 11 includes a recording medium ID 1130 identifying the type of recording medium, and permeation speed information 1151 indicating whether recording medium is permeable or non-permeable, for each type of recording medium. The first determination reference information table 1121 is previously stored in the memory 112. Here, "permeable" and "non-permeable" are classified as follows. Namely, any recording medium where the permeation speed of a prescribed ink per prescribed surface area of the recording medium is equal to or lower than a prescribed threshold value, is classified as "non-permeable". On the other hand, any recording medium having a permeation speed exceeding this threshold value is classified as "permeable". In other words, any recording medium in which the permeation duration of the prescribed ink per the prescribed surface area of the recording medium is greater than a prescribed threshold value, is designated as a "non-permeable" medium, and any recording medium having a permeation duration equal to or less than this threshold value is designated as a "permeable" medium. For example, when a droplet of 2 pl of aqueous solution having the surface tension of 30 mN/m and the viscosity of 3 cP is deposited on a recording medium, the recording medium that has the permeation duration of more than 100 ms, is classified as a "non-permeable" medium, and the recording medium that has the permeation duration of 100 ms or less is classified as a "permeable" medium.

In the first determination reference information table 1121, the recording medium ID 1130 ("P001", "C001", and the like) and the permeation speed information 1151 ("non-permeable" or "permeable") are previously recorded for each of a plurality of recording media. For example, special inkjet papers (printing papers), special OHP sheets for copying machines, and the like, are classified as the non-permeable media, whereas special copying machine paper (copy paper), special inkjet OHP sheets, and the like, are classified as the permeable media. The permeation speed information 1151 corresponding to the recording medium ID inputted to the recording medium ID input unit 113 is read out from the memory 112. For example, in the case of a "non-permeable" recording medium, the total droplet deposition volume of the treatment liquid and the ink is compared with a prescribed threshold value (e.g., 1.5 ml for a surface area equivalent to A4 paper size). If the total droplet deposition volume exceeds the threshold value, then it is determined that the solvent absorption is to be performed. If the total droplet deposition volume is equal to or less than the threshold value, then it is determined that the solvent absorption is not to be performed. On the other hand, in the case of a "permeable" recording medium, it is determined that the solvent absorption is not to be performed, regardless of the total droplet deposition volume.

The determination between the permeable and non-permeable media may be made before the start of print (image formation). For example, it is possible to make the determination when the type of recording medium on which printing is to be performed is inputted.

A second mode of the determination of the requirement of the solvent absorption is described below, principally with reference to FIG. 12. A second determination reference information table 1122 shown in FIG. 12 includes a recording medium ID 1130 identifying the type of recording medium, an ink ID 1140 identifying the type of ink, and a permeation duration 1152, for each combination of the recording medium ID 1130 and the ink ID 1140. The second determination reference information table 1122 is previously stored in the memory 112. The permeation duration 1152 is the permeation duration when a prescribed quantity of ink is deposited onto the recording medium (this permeation duration corresponds to the reciprocal of the permeation speed). The recording medium ID 1130, ink ID 1140, and permeation duration 1152 are previously registered in the second determination reference information table 1122, with respect to each of-the combinations of the recording media and the inks. The permeation duration 1152 corresponding to the combination of the recording medium and the ink indicated by the recording medium ID inputted to the recording medium ID input unit 113 and the ink ID inputted to the ink ID input unit 114 is read out from the memory 112. For example, if the read permeation duration exceeds a prescribed threshold value, then the medium is determined to be "non-permeable", and it is then determined whether the solvent absorption is required or not by determining the total amount of the treatment liquid and the ink deposited on the recording medium. On the other hand, if the read permeation duration is equal to or less than the prescribed threshold value, then the medium is determined to be "permeable", and it is determined that the solvent absorption is not to be performed.

The mode of determining the requirement for the solvent absorption is not limited to these modes. For example, it is also possible to previously store the surface tension and the viscosity in the memory 112 with respect to each type of various inks, as well as to previously store a determination reference value for the surface tension and a determination reference value for the viscosity in order to determine "permeable" or "non-permeable" for each type of recording media. Before actually forming an image, the surface tension and the viscosity of the ink corresponding to the ink ID inputted to the ink ID input unit 114 are read out from the memory 112, and the surface tension determination reference value and the viscosity determination reference value corresponding to the recording medium ID inputted to the recording medium ID input unit 113 are read out from the memory 112. The surface tension and the viscosity of the ink that is actually to be used are compared with the determination reference values for the recording medium that is actually to be used, and it is determined whether the solvent absorption is required or not.

In image forming conditions where the combination of the recording medium and the ink is fixed, it is possible to determine the requirement for the solvent absorption according to only the total amount of the treatment liquid and the ink deposited on the recording medium.

For example, at least one of the amount of the ink deposited per unit surface area of the recording medium by the ink droplet ejection head 12, and the amount of the treatment liquid deposited per unit surface area of the recording medium by the treatment liquid droplet ejection head 16, is calculated according to the image data relating to the image formation. If the calculated amount exceeds a prescribed threshold value, then it is determined that the solvent absorption is to be carried out. If the calculated amount is equal to or less than the threshold value, then it is determined that the solvent absorption is not to be carried out.

Whole Sequence of Image Forming Process

Figure 13:
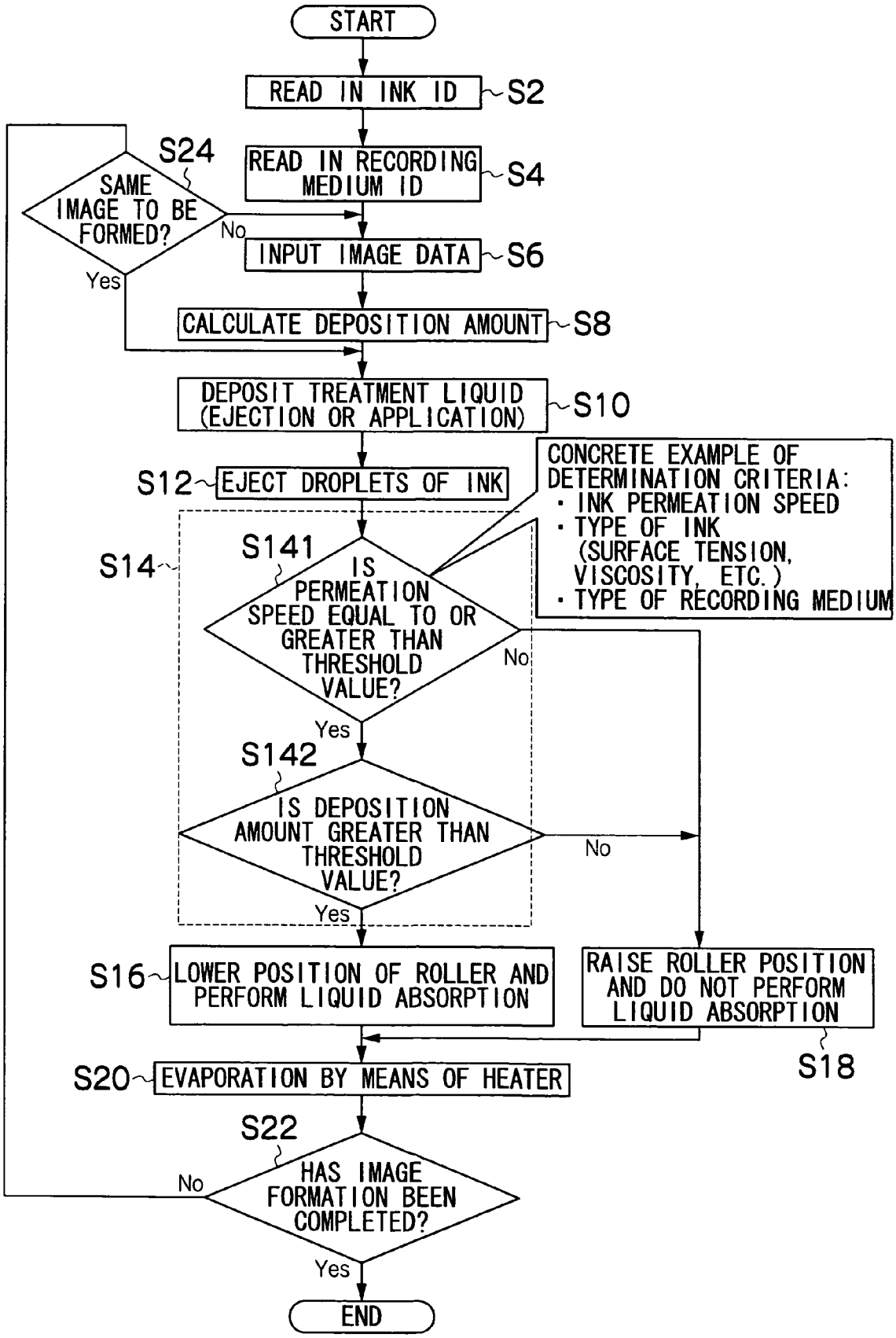
FIG. 13 is a flowchart showing the sequence of an example of an image forming process.

FIG. 13 is a flowchart showing the sequence of one example of an image forming process in the inkjet recording apparatus 10 according to the present embodiment. The respective steps of this image forming process are executed under the management of the main control unit 110, in accordance with a prescribed program.

The ink ID is previously read in by the ink ID input unit 114 (S2), and the recording medium ID is previously read in by the recording medium ID input unit 113 (S4).

When image data is inputted from the host computer 300 to the image forming apparatus 10 (S6), then the deposition volume of the ink to be deposited on the recording medium by the ejection of ink droplets, and the deposition volume of the treatment liquid to be deposited on the recording medium by the ejection of treatment liquid droplets are calculated on the basis of this image data (S8).

The coloring material in the ink is actually to be fixed to the recording medium 20, and it is hence possible to calculate only the amount of the solvent in the ink, rather than calculating the ink deposition volume for the whole of the ink,.

Although the aforementioned description relates to an example where both the ink deposition volume and the treatment liquid deposition volume are calculated, there are, in fact, also cases where only the ink deposition volume or only the treatment liquid deposition value is calculated. For example, if the amount of the treatment liquid remaining on the recording medium after the insolubilization of the ink is so small as to be negligible with respect to the volume of the ink solvent, then it is possible to calculate the ink deposition volume (or solvent volume) only. Furthermore, if the amount of the ink solvent is negligible with respect to the amount of the treatment liquid remaining on the recording medium after the insolubilization of the ink, then it is also possible to calculate only the deposition volume of the treatment liquid.

Next, the recording medium 20 is relatively moved with respect to the treatment liquid droplet ejection head 16 while droplets of the treatment liquid are ejected toward the recording medium 20 by the treatment liquid droplet ejection head 16 (S10), and the recording medium 20 is relatively moved with respect to the ink droplet ejection head 12 while droplets of the ink are ejected toward the recording medium 20 by the ink droplet ejection head 12 (S12).

A determination is made regarding whether the liquid (mainly, ink solvent) deposited on the recording medium 20 is absorbed by means of the porous roller 18 or not (the determination of the requirement of the solvent absorption) (S14).

More specifically, firstly, it is determined whether the permeation speed of the ink into the recording medium is greater than a prescribed threshold value (permeation speed threshold value) or not (S141). In other words, it is determined whether the recording medium is a non-permeable medium (namely, a medium having the permeation speed equal to or lower than the prescribed threshold value) or a permeable medium (namely, a medium having the permeation speed that is greater than the prescribed threshold value). Secondly, it is determined whether the total amount of the droplet deposition of the ink and the treatment liquid onto the recording medium is greater than a prescribed threshold value (droplet deposition threshold value) or not (S142).

Although the above description relates to a case where both the droplet deposition volume of the ink and the droplet deposition volume of the treatment liquid are taken for consideration for performing the above-mentioned determination, there are also cases where either one of the ink droplet deposition volume and the treatment liquid droplet deposition volume is taken for consideration for performing the determination.

If, as a result of the determination of the requirement of the solvent absorption (S14), it is determined that the recording medium is the non-permeable medium (the medium having the permeation speed equal to or lower than the threshold value), and that the droplet deposition volume is greater than the prescribed threshold value, then the porous roller 18 used for the solvent absorption is lowered and set in the absorbing position as shown in FIG. 5 in such a manner that the liquid (mainly, the ink solvent) on the recording medium is absorbed by the porous roller 18 (S16). On the other hand, if the recording medium is the permeable medium (the medium having the permeation speed greater than the threshold value), or if the recording medium is a non-permeable medium but the droplet deposition volume is equal to or less than the prescribed threshold value, then the porous roller 18 for the solvent absorption is raised and set in the non-absorbing position as shown in FIG. 6 in such a manner that the solvent absorption is not performed by the porous roller 18 (S18).

Next, as shown in FIG. 7, the liquid (mainly, the ink solvent) on the recording medium 20 is caused to evaporate by heating the recording medium 20 by means of the halogen heater 19 (S20).

It is determined whether image formation has been completed or a further image formation operation is to be performed (S22). If a further image formation operation is to be performed, then it is determined whether the same image is to be formed again or not (S24).

If it is determined in the step S24 that the same image is to be formed again, then the input of image data (S6) and the calculation of the deposition volume (S8) are not necessary, and the steps of the droplet ejection of the treatment liquid (S10), the droplet ejection of the ink (S12), and the determination of the requirement of the solvent absorption (S14) are carried out. If it is determined that the solvent absorption is required, then the solvent absorption by the porous roller 18 (S16) and the solvent evaporation by the halogen heater 19 (S22) are carried out. On the other hand, if it is determined that the solvent absorption is not required, then the solvent absorption by the porous roller 18 is not carried out (S18), and only the solvent evaporation by the halogen heater 19 is performed (S22).

If it is determined in the step S24 that a different image is to be formed, then input of new image data (S6) and calculation of the droplet deposition volume based on this new image data (S8) are carried out, whereupon the steps of the droplet ejection of the treatment liquid (S10), the droplet ejection of the ink (S12), and the determination of the requirement of the solvent absorption (S14) are performed. If it is determined that the solvent absorption is required, then the solvent absorption by the porous roller 18 (S16) and the solvent evaporation by the halogen heater 19 (S22) are carried out. On the other hand, if it is determined that the solvent absorption is not required, then the solvent absorption by the porous roller 18 is not carried out (S18), and only the solvent evaporation by the halogen heater 19 is performed (S22).

The example in FIG. 13 shows a case where the solvent removal selection device controls only whether the porous roller 18 is used or not by moving the porous roller 18 toward or away from the recording medium 20. However, it is also possible to adjust the clearance between the porous roller 18 and the recording medium 20 when the porous roller 18 is to be used. More specifically, in the step of lowering the position of the porous roller 18 (S16), the vertical position of the porous roller 18 is adjusted by the elevating devices 214 in such a manner that the clearance between the outer circumferential surface of the porous roller 18 and the recording medium 20 is adjusted on the basis of at least one of the permeation speed of the ink into the recording medium 20, and the droplet deposition volume of the ink. Moreover, it is also possible to press the porous roller 18 against the recording medium 20 (and it is further possible to control the pressure of the porous roller 18 against the recording medium 20), according to requirements.

Although the conveyance speed of the recording medium is not changed in the example shown in FIG. 13, it is also possible to change the conveyance speed of the recording medium 20 by the conveyance belt 43 in such a manner that the contact duration per unit surface area between the recording medium 20 and the outer circumferential surface of the porous roller 18 is adjusted on the basis of the degree of permeation of the ink into the recording medium 20 and the ink droplet deposition volume on the recording medium 20.

Although the case where the solvent is absorbed by the single porous roller 18 is described above, it is also possible to select the porous roller 18 that is to be used for the solvent absorption, from among a plurality of types of the porous rollers 18 having different pore diameters and/or materials of the porous members.

Other Embodiments

In order to facilitate understanding of the embodiment of the present invention, the image forming apparatus is described above with reference to the case where droplets of one color of ink (for example, black ink) are ejected toward the recording medium 20. However, in order to form a color image on the recording medium 20, it is necessary to eject droplets of a plurality of colors of the ink toward the recording medium 20.

FIG. 14 shows the principal parts of the image forming apparatus 10 which is capable of ejecting droplets of the inks of four colors, yellow (Y), cyan (C), magenta (M) and black (K) toward the recording medium 20, and is composed in such a manner that droplets of the treatment liquid are ejected for each of the inks of the colors Y, C, M, and K.

In FIG. 14, treatment liquid droplet ejection heads 16K, 16M, 16C and 16Y are disposed respectively before ink droplet ejection heads 12K, 12M, 12C and 12Y In FIG. 14, porous rollers 18K, 18M, 18C, and 18Y are disposed respectively after the ink droplet ejection heads 12K, 12M, 12C, and 12Y. The recording medium on the conveyance belt 43 driven by the drive rollers 41 and 42 is successively conveyed to a droplet deposition position of the first treatment liquid droplet ejection head 16K, a droplet deposition position of the first ink droplet ejection head 12K, an absorption position of the first porous roller 18K, a droplet deposition position of the second treatment liquid droplet ejection head 16M, a droplet deposition position of the second ink droplet ejection head 12M, an absorption position of the second porous roller 18M, a droplet deposition position of the third treatment liquid 16C, a droplet deposition position of the third ink droplet ejection head 12C, an absorption position of the third porous roller 18C, a droplet deposition position of the fourth treatment liquid droplet ejection head 16Y, a droplet deposition position of the fourth ink droplet ejection head 12Y, an absorption position of the fourth porous roller 18Y, and an evaporation position of the halogen heater 19.

FIG. 15 shows the principal parts of the image forming apparatus 10 which is capable of ejecting droplets of the inks of four colors, Y, C, M and K, toward the recording medium 20, and is composed in such a manner that droplets of the treatment liquid are ejected toward the recording medium 20 in one operation before ejecting droplets of the inks of the colors Y, C, M and K.

In FIG. 15, a single treatment liquid droplet ejection head 16 is disposed before the ink droplet ejection head 12K for black (K) ink in terms of the conveyance direction of the recording medium 20 (on the right-hand side in FIG. 15). Furthermore, a single porous roller 18 is disposed after the ink droplet ejection head 12Y for yellow (Y) ink in terms of the conveyance direction of the recording medium 20 (the left-hand side in FIG. 15). The recording medium on the conveyance belt 43 driven by the drive rollers 41 and 42 is successively conveyed to a droplet deposition position of the treatment liquid droplet ejection head 16, a droplet deposition position of the first ink droplet ejection head 12K, a droplet deposition position of the second ink droplet ejection head 12M, a droplet deposition position of the third ink droplet ejection head 12C, a droplet deposition position of the fourth ink droplet ejection head 12Y, an absorption position of the porous roller 18, and an evaporation position of the halogen heater 19.

FIG. 16 shows the principal parts for image formation by the image forming apparatus 10 which is capable of ejecting droplets of the inks of four colors, Y, C, M and K toward the recording medium 20, and applies the treatment liquid to the recording medium 20 before ejecting droplets of the inks of the colors Y, C, M and K.

In FIG. 16, a single treatment liquid application roller 16' is disposed before the ink droplet ejection head 12K for black (K) ink in terms of the conveyance direction of the recording medium 20 (on the right-hand side in FIG. 16). Furthermore, a single porous roller 18 is disposed after the ink droplet ejection head 12Y for yellow (Y) ink in terms of the conveyance direction of the recording medium 20 (the left-hand side in FIG. 16). The recording medium on the conveyance belt 43 driven by the drive rollers 41 and 42 is successively conveyed to an application position of the treatment liquid application roller 16', a droplet deposition position of the first ink droplet ejection head 12K, a droplet deposition position of the second ink droplet ejection head 12M, a droplet deposition position of the third ink droplet ejection head 12C, a droplet deposition position of the fourth ink droplet ejection head 12Y, an absorption position of the porous roller 18, and an evaporation position of the halogen heater 19.

In the embodiment shown in FIG. 16, the amount of the treatment liquid applied to the recording medium 20 by the treatment liquid application roller 16' corresponds to the deposition amount of the treatment liquid on the recording medium 20.

In the embodiments shown in FIGS. 14 and 15, by controlling the treatment liquid deposition volume according to the ink droplet deposition pattern, it is possible to reduce the consumption of the treatment liquid. On the other hand, in the embodiment shown in FIG. 16, it is possible to apply to the recording medium, the treatment liquid having a high viscosity that is difficult to eject in the form of droplets from the treatment liquid droplet ejection head.

As described above, the initial solvent removal is swiftly performed by the porous roller 18 according to the permeation speed of the recording medium and/or the droplet deposition volume, whereupon the final solvent removal is performed without making contact with the recording medium, by the halogen heater 19, and furthermore, it is also possible to perform the solvent removal by means of the evaporation by the halogen heater 19 alone, without performing solvent absorption by the porous roller 18. Therefore, the solvent can be swiftly removed from the recording medium to a degree where there is little or no effect on the coloring material component of the ink adhering to the recording medium.

For example, if both the solvent absorption and the solvent evaporation are performed, then approximately one half of the maximum deposition amount Dmax of the liquid droplets is removed by the solvent evaporation, and the solvent absorption is performed before this solvent evaporation according to requirements.

The maximum deposition amount Dmax is the maximum value of the deposition amount of the ink and the treatment liquid when the ink droplets are ejected toward a region of a prescribed surface area. In general, the maximum deposition amount Dmax is equal to the deposition amount in a case where an intermediate color of two colors from among C, M, and Y is to be formed on the whole surface of the region of a prescribed surface area. For example, if the ink droplets are to be ejected onto the whole surface of an area equivalent to A4 size (210 mm×297 mm), the amount of the treatment liquid is 1.0 ml and the total amount of the two color inks is 2.0 ml (1 ml of each color), then the total deposition volume is 3.0 ml. In the case of light colors or a single color, the droplet deposition volume is smaller than in the case of two colors. If three colors are to be mutually superimposed, then black ink is actually used, and hence the total deposition volume generally becomes less than 3.0 ml.

Therefore, the solvent evaporating unit 19 used in the present embodiment has a capacity to evaporate 1.5 ml of the liquid, which is one half of the 3.0 ml of the maximum deposition volume in a region equivalent to A4. Since the heat of vaporization of water is approximately 2.3 J/ml, then the heat quantity required to evaporate the 1.5 ml of the liquid is around 3.5 J, and it is preferable that a heat source having the heating capacity exceeding this is used.

In this case, if the recording medium is a non-permeable medium and the droplet deposition volume exceeds 1.5 ml in an area equivalent to A4 size, then the solvent removal selection unit 210 selects performing the solvent removal by both the solvent absorbing unit 18 and the solvent evaporating unit 19. On the other hand, if the recording medium is a non-permeable medium and the droplet deposition volume is 1.5 ml or less, then the solvent removal selection unit 210 selects performing the solvent removal by means of the solvent evaporating unit 19 only, without using the solvent absorbing unit 18. Furthermore, if the recording medium is permeable, then the solvent removal selection unit 210 implements solvent removal by means of the solvent evaporating unit 19 only, regardless of the droplet deposition volume.

In the above-described embodiments, it is possible to use, as the treatment liquid, an aqueous solution, for example, containing at least the following substances:

| | |
|---|---|
| Sharol DC-902P, manufactured by Dai-Ichi Kogyo Seiyaku Co., Ltd.: | 1 to 20 wt %; and |
| Olfine E1010, manufactured by Nissin Chemical Industry Co., Ltd. (as a surface-active agent): | 0.1 to 10 wt %. |

The following substances can be added to this aqueous solution:

| | |
|---|---|
| glycerol (as a high-boiling-point solvent): | 0 to 30 wt %; and |
| triethanolamine (as a pH adjuster): | 0 to 10 wt %. |

Figure 17A:
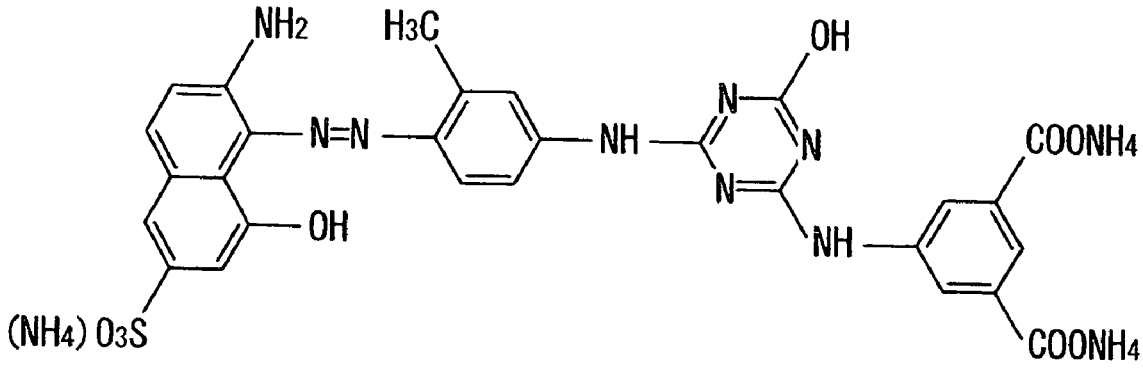
FIGS. 17A to 17C are structural formulas of examples of anionic dye compounds used in the inkjet recording apparatus.
Figure 17B:
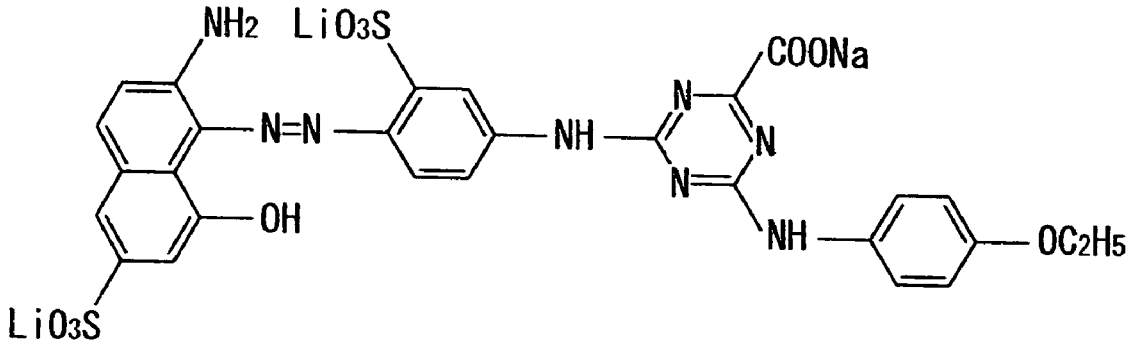
Figure 17C:
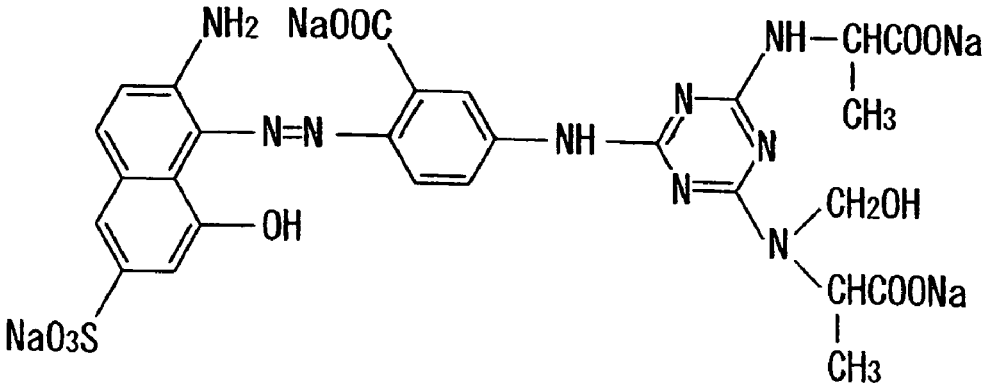

On the other hand, it is possible to use, as an ink containing a coloring material, an aqueous solution, for example, containing at least the following substances:

| | |
|---|---|
| an anionic dye compound having the structure shown in FIG. 17A, 17B or 17C, for example: | 1 to 30 wt %; and |
| Olfine E1010, manufactured by Nissin Chemical Industry Co., Ltd. (as a surface-active agent): | 0.1 to 10 wt %. |

The following substances can be added to this aqueous solution:

| | |
|---|---|
| polystyrene sodium sulfonate | 0 to 20 wt %; |
| glycerol (as a high-boiling-point solvent): | 0 to 30 wt %; and |
| triethanolamine (as a pH adjuster): | 0 to 10 wt %. |

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink ejection device which ejects a droplet of ink toward a recording medium, the ink including a solvent and a coloring material dissolved or dispersed in the solvent;

a treatment liquid deposition device which deposits a treatment liquid on the recording medium, the treatment liquid separating the coloring material from the solvent on the recording medium;

a solvent absorbing device which absorbs the solvent on the recording medium;

a solvent evaporating device which effects evaporation of the solvent on the recording medium by (1) directing heat from a heat source toward the recording medium or (2 ) generating a flow of air toward the recording medium; and a solvent removal selection device which selects one removal way of a first removal way where the solvent on the recording medium is removed by absorbing the solvent using the solvent absorbing device and then effecting evaporation of the solvent using the solvent evaporating device, and a second removal way where the solvent on the recording medium is removed by effecting evaporation of the solvent using the solvent evaporating device without using the solvent absorbing device.

2. The image forming apparatus as defined in claim 1, wherein the treatment liquid deposition device deposits the treatment liquid on the recording medium by ejecting a droplet of the treatment liquid toward the recording medium.

3. The image forming apparatus as defined in claim 1, wherein the treatment liquid deposition device deposits the treatment liquid on the recording medium by applying the treatment liquid to the recording medium.

4. The image forming apparatus as defined in claim 1,further comprising:

a calculation device which calculates at least one of volume of the ink to be deposited on the recording medium and volume of the treatment liquid to be deposited on the recording medium, according to data of an image to be formed on the recording medium, wherein the solvent removal selection device selects the one removal way according to the at least one of the volume of the ink and the volume of the treatment liquid calculated by the calculation device.

5. The image forming apparatus as defined in claim 1, wherein the solvent removal selection device selects the one removal way according to permeation speed of the ink into the recording medium.

6. The image forming apparatus as defined in claim 1, further comprising:

a medium information input device to which identification information on the recording medium is inputted; and a storage device which stores relation information for each type of recording medium, the relation information indicating relation between the identification information on the recording medium and information indicating degree of permeation of the ink into the recording medium, wherein the solvent removal selection device selects the one removal way according to the identification information inputted to the medium information input device and the relation information stored in the storage device.

7. The image forming apparatus as defined in claim 1, wherein:

the solvent absorbing device is a roller which has an outer circumferential surface made of a material absorbing liquid and is rotatably disposed on a conveyance path along which the recording medium is conveyed; and the solvent removal selection device controls contact and separation between the outer circumferential surface of the roller and the recording medium conveyed along the conveyance path.

* * * * *